US011499332B2

(12) United States Patent
Zobec et al.

(10) Patent No.: US 11,499,332 B2
(45) Date of Patent: Nov. 15, 2022

(54) DISSIPATIVE BRACKET TO MITIGATE EFFECTS OF EXPLOSIONS ON BUILDING FACADES

(71) Applicant: PERMASTEELISA S.P.A., Vittorio Veneto (IT)

(72) Inventors: Marc Tony Zobec, Vittorio Veneto (IT); Guido Lori, Vittorio Veneto (IT)

(73) Assignee: PERMASTEELISA S.P.A., Vittorio Veneto (IT)

( * ) Notice: Subject to any disclaimer, the term of this patent is extended or adjusted under 35 U.S.C. 154(b) by 0 days.

(21) Appl. No.: 17/056,123

(22) PCT Filed: May 20, 2019

(86) PCT No.: PCT/IT2019/050108
§ 371 (c)(1),
(2) Date: Nov. 17, 2020

(87) PCT Pub. No.: WO2019/224853
PCT Pub. Date: Nov. 28, 2019

(65) Prior Publication Data

US 2021/0222450 A1 Jul. 22, 2021

(30) Foreign Application Priority Data

May 21, 2018 (IT) ..... 102018000005568

(51) Int. Cl.
*E04H 9/04* (2006.01)
*E06B 5/10* (2006.01)
*E04B 2/88* (2006.01)

(52) U.S. Cl.
CPC ..... *E04H 9/04* (2013.01); *E04B 2/88* (2013.01); *E06B 5/10* (2013.01)

(58) Field of Classification Search
CPC ..... E06B 5/10; E06B 5/12; E04H 9/04; E04B 2/88; E04B 2/885; E04B 2/96; E04B 2/965; E04B 2/967
See application file for complete search history.

(56) References Cited

U.S. PATENT DOCUMENTS 4,630,411 A * 12/1986 Salzer ..... E06B 5/10 109/27
6,349,505 B1 * 2/2002 Figge ..... E06B 5/12 49/64

(Continued)

FOREIGN PATENT DOCUMENTS

DE 20 2015 105403 10/2015

OTHER PUBLICATIONS

International Search Report and Written Opinion of PCT/IT2019/050108 dated Dec. 7, 2019, 8 pages.

*Primary Examiner* — Andrew J Triggs
(74) *Attorney, Agent, or Firm* — Rankin, Hill & Clark LLP

(57) ABSTRACT

A glazed façade anchoring system to a building including a box with a connection system to the façade and connection to the building slab. The first and second connections enable relative movement between one another, when the façade moves within the gap between the rear surface of the façade and the building slab edge under the high pressure loads due to exceptional events such as explosions. The device includes one or more solid elements with dissipative components acting in compression in the inward building direction and one or more solid elements with dissipative components acting in compression in the outward building direction.

11 Claims, 23 Drawing Sheets

(56) References Cited

U.S. PATENT DOCUMENTS

| | | | | |
|---|---|---|---|---|
| 2008/0086960 | A1* | 4/2008 | Emek | E06B 5/12<br>52/745.18 |
| 2010/0307386 | A1* | 12/2010 | Stockhausen | E06B 5/12<br>109/79 |
| 2013/0042551 | A1* | 2/2013 | Koutsoukos | E06B 9/02<br>52/698 |
| 2021/0222450 | A1* | 7/2021 | Zobec | E04B 2/96 |

* cited by examiner

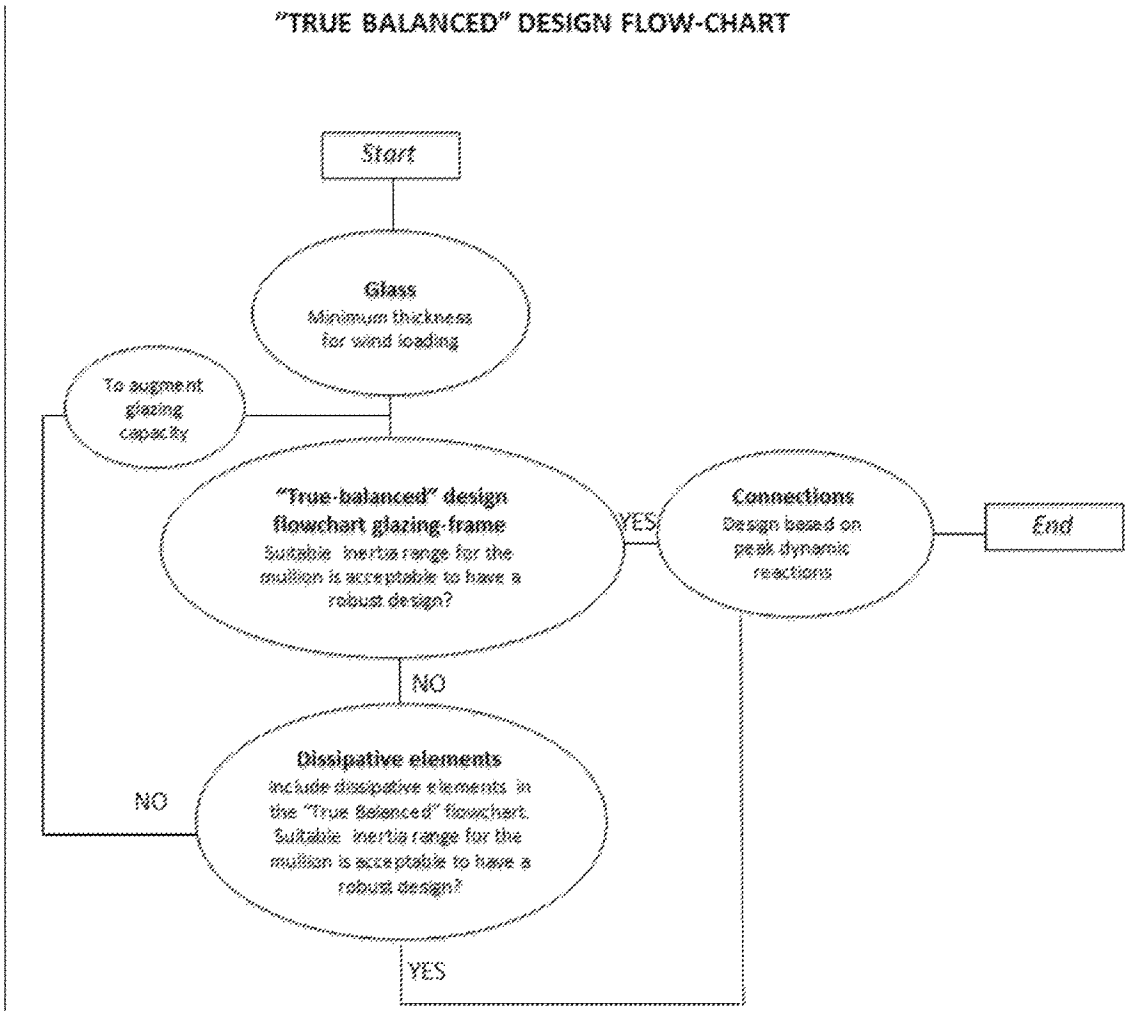
Fig. 4
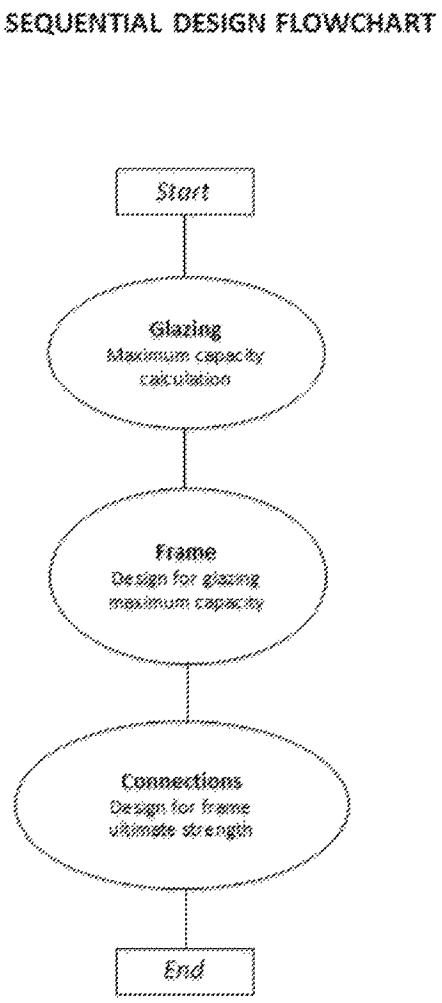

North elevation

Horizontal cross section

DISSIPATIVE BRACKET TO MITIGATE EFFECTS OF EXPLOSIONS ON BUILDING FACADES

FIELD OF THE INVENTION

The present invention relates to the façade design for buildings resistance enhancement due to the effects of explosions.

STATE OF THE ART

Current design solutions for blast resistant façades adopt a dissipative philosophy, in contrast to traditional approaches that considered the design of blast enhanced façades to resist blast pressure wave effects by means of a rigid response predominantly within the elastic range. Current design solutions assume that the primary function of the façade is to protect the internal occupants and assets of the building by preventing the blast wave breaching the façade surface, but the preferable approach is to permit controlled permanent facade deformations that in effect dissipate a significant proportion of the blast wave energy. With this approach, load transfer from the façade to the primary building structure is reduced, with the advantage of reducing the risk of progressive collapse. The façade is a sacrificial element, which may be replaced in the event of a blast. For this purpose, façade components can be designed in compliance with various performance levels. Performance is maintained with regards to structural integrity, with the aim to mitigate fragmentation hazards and framing plastic failure, both in the inward and outward (rebound) building directions. The major protection paradox is related to the increased architectural requirement for transparency: glass being a brittle material characterized by sharp and hazardous fragmentation in the event of catastrophic failure. Even if the use of the laminated glass can mitigate the risk of a global catastrophic element failure, protection requirements are focused on mitigating potential injuries to the building occupants due to blunt trauma and laceration injuries due to glazing splinters. Often the projection of fragments in the outward direction is also mitigated, in order to permit effective rescue operations and promptly reinstate building activities. Several façade anchoring systems to the primary building structure have been proposed in recent years. First generation blast enhanced façades generation were characterized by resistant (very rigid) elements; whilst second generation blast enhanced facades made more effective use of the energy dissipation principles by designing major components to undergo permanent, appreciable yet controlled deformations and for this reason were commonly referred as optimally enhanced. Connections between façade elements and between the overall façade panel and building frame required significant reinforcement due to the large blast load transfer. However, opportunities for further optimization exist, through the need for energy absorbing anchoring systems, designed to lower reactions in the event of threats in close proximity to the building, without significant impacts on fabrication and installation costs.

SUMMARY OF THE INVENTION

These objectives will be achieved by means of a façade anchoring system in accordance to claim 1.

The anchoring system of the invention, referred as bracket in the following description, can be implemented into state of the art blast enhanced facades and in particular can be representative in new design solution, which can be defined "protective". By means of the invention, protection can be augmented both in the inward and outward building directions and in terms of hazard mitigation to the building structure and occupants. The difference between the new system and current state-of-the-art is that the bracket is dissipative, compared with traditional anchoring systems. The inventive anchoring system has more advantages than first and second generation state-of-the-art brackets, because its resilience and protection performance can be maximized and optimized through the use of its deformability. The anchoring system is designed to resist as a rigid elastic element when subject to traditional loads such as dead loads, wind, impacts. Beyond a certain predefined and tuned value, the anchoring system deforms significantly, following a controlled resistance versus deformation plateau: the façade moves closing the gap between the slab and back of the façade unit. Through this mechanism, two major beneficial effects are achieved:

- The reaction transferred to the building frame doesn't exceed the predefined plateau level, which is a characteristic value of the specific anchoring system. Peak reaction reduction is in the range of 50-70% with respect to the rigid load transfer brackets.
- The façade components such as glass and framing are subjected to lower loads and hence stresses when compared with the rigid bracket scenario.

BRIEF DESCRIPTION OF DRAWINGS

Further benefits of the invention will become more apparent in the various preferred embodiments described in detail by way of non limitative examples in the attached figures.

FIG. 4 shows a flow chart representing the sequential calculation method, which is the state of the art reference method (left side), compared with the flowchart of the true balanced design (invention) method (right side)

The same elements or component correspond to the same reference numbers in the different figures.

DETAILED DESCRIPTION OF PREFERRED EMBODIMENTS OF THE INVENTION

Figure 1A:
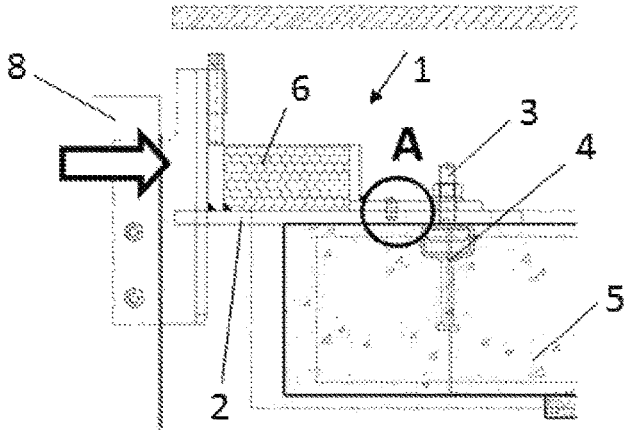
FIG. 1 shows the vertical cross section of the anchoring system subjected to the traditional loads such as wind (case A), the anchoring system under the inward phase of the blast load (case B) and the outward dynamic response (case C) in a first embodiment.
Figure 1B:
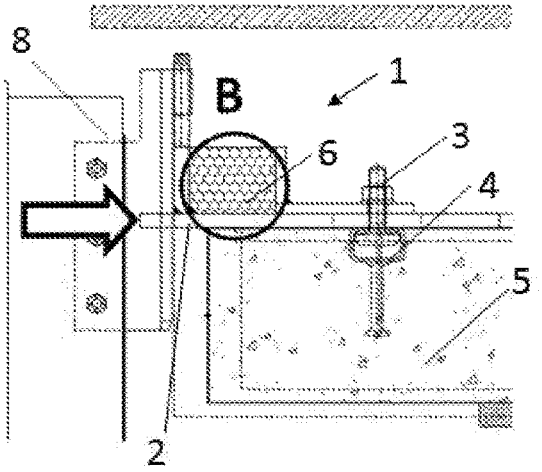
Figure 1C:
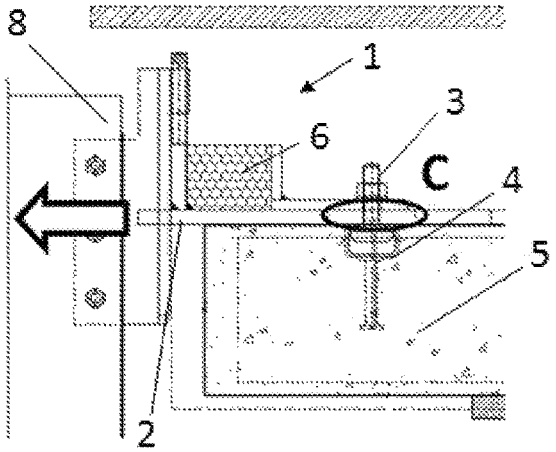
Figure 7:
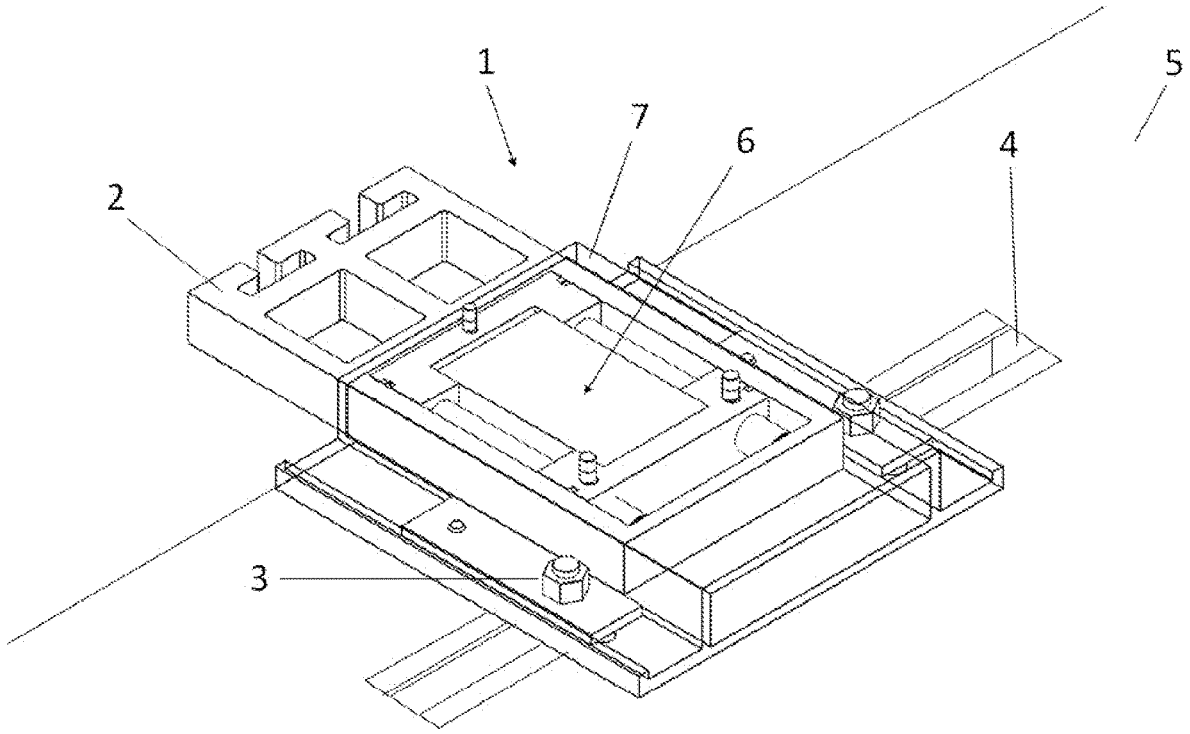
FIG. 7 shows a second design solution axonometric view.
Figure 8A:
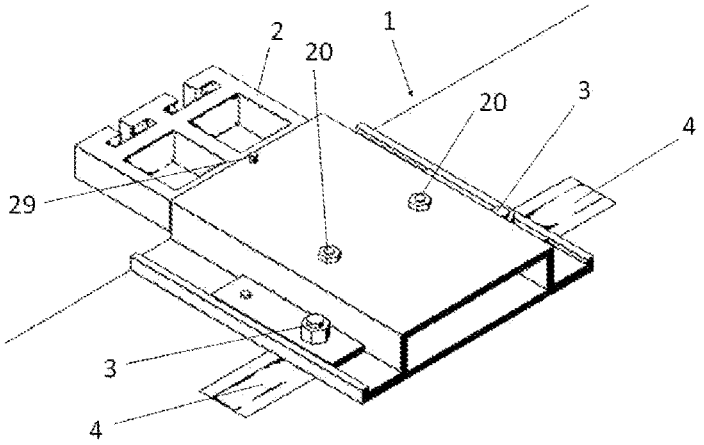
FIGS. 8A, 8B and 8C show an axonometric view of the anchoring system of the invention in three different operative positions: neutral position, inward (blast pressure wave) movement and outward (negative pressure wave and rebound) movement.
Figure 8B:
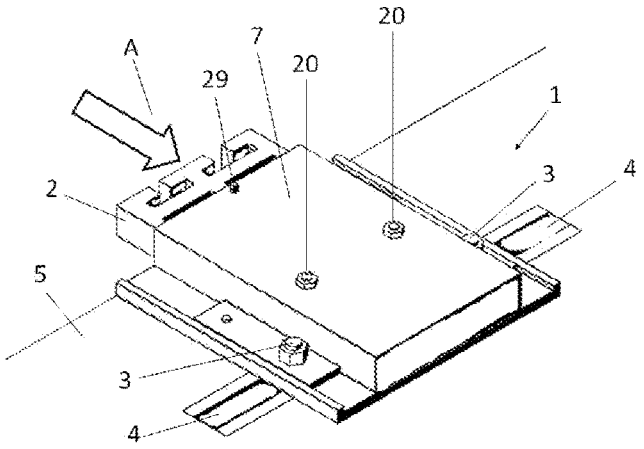
Figure 8C:
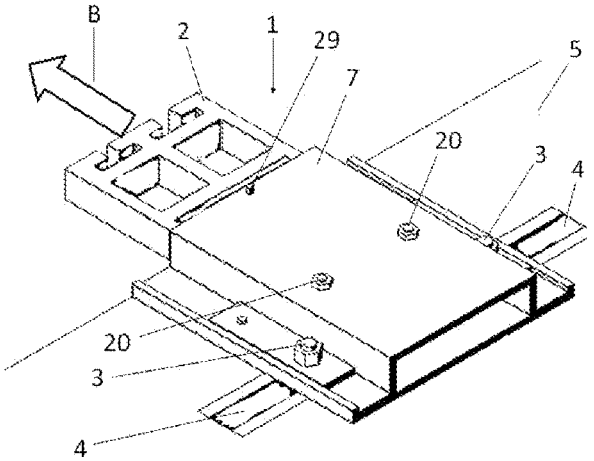

With particular reference to FIGS. 1, 7 and 8, where the main design features of the novel dissipative bracket are visible, it is represented by reference 1. The dissipative bracket 1 is fixed at the top of the slab, according to a conventional layout of the curtain wall façade. Other design solutions are however possible, without loss of applicability of the invention. The dissipative bracket 1 is in general fixed at the slab by means of bolts 3, which connect it to a cast-in channel 4 embedded into the slab 5. One movable box 2 into a fixed box 7 connected to the slab 5 by means of the above cited bolts 3 shows a dissipative element 6 into a room. The movable box 2 is connected to the façade, like for instance a unitized glass aluminium system 8. Under rigid behavior (Phase A), the two parts are both fixed, connected by means of pins 29 (optional) and by means of the resistance exerted by the dissipative components, which behave in rigid way below a certain reaction force. Once the reaction exceeds a certain design value (Phase B), the pin 29 breaks and the dissipative elements between movable and fixed part are compressed according to the resistance function. The compression length can make use of the full distance between the façade and the slab, in general 50-100 mm, including slab position tolerances as well.

One fundamental characteristic of the invention anchoring system is that it contains two series of dissipative elements, the first one activated by the inward response phase of the façade under the blast wave and the second one that are compressed under the rebound outward phase (Phase C). This second phase is often governing the design of the cast in channel 4, then a suitable slip should be provided on the outward direction as well. However, as shown in the drawings, the deformation is in general smaller than the required to absorb the blast wave energy during the inward response phase.

Figure 3:
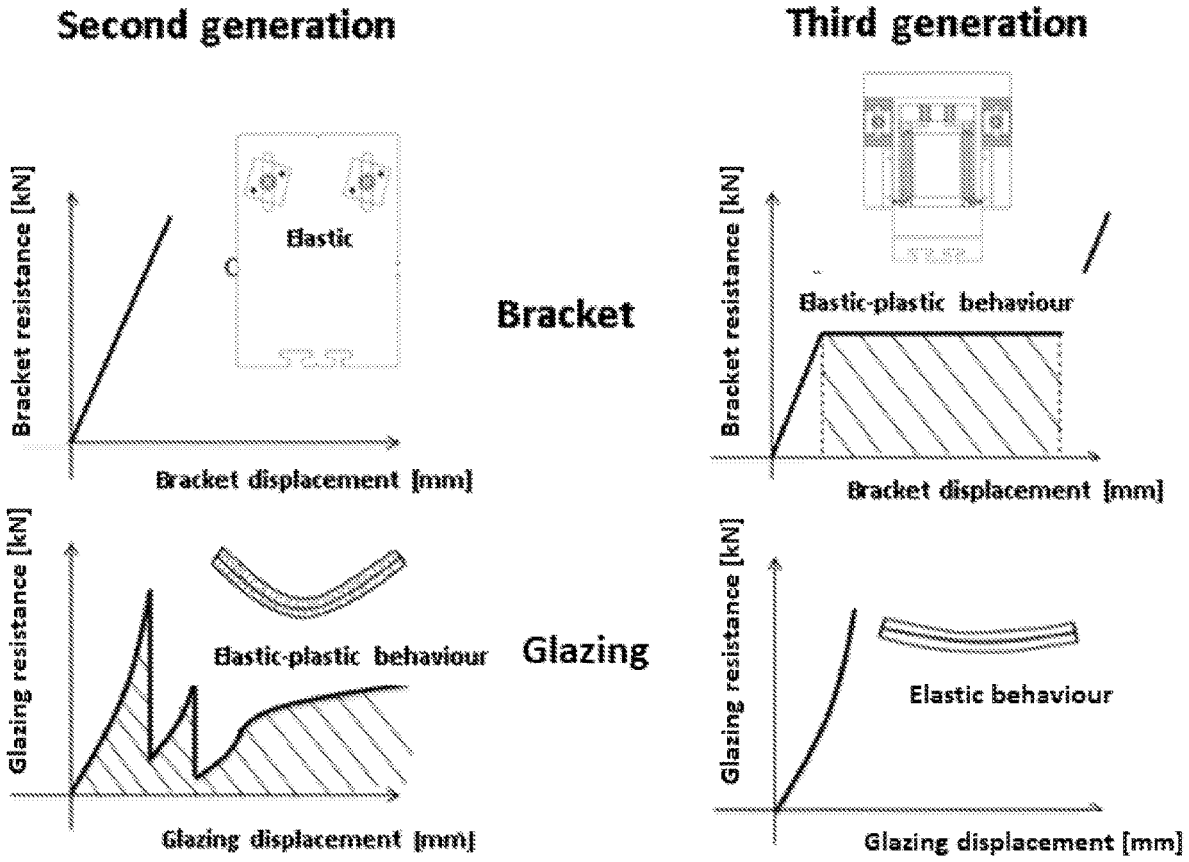
FIG. 3 shows comparative charts with the resistance behavior of a glazing versus deformation when the invention is adopted (right side) compared with a state of the art anchoring system (left side)

The charts of the FIG. 3 show the difference between the second and third generation of the blast facades. While in the second generation the behavior of the bracket was rigid and the overall dissipation was concentrated into the glass, by means of the invention anchoring system the same level of dissipation can be achieved, but moving it mostly at the bracket level. The consequence is that hazard level is reduced, because the inner glass will displace less and under lower velocity, then projecting less splinters into the building. Rating according to blast testing standards like ISO16933 (2007), EN13541, EN13123-1, EN13123-2, EN13124-1, EN13124-2, ASTMF1642 will be then improved In the following text there will be a description of the true balanced design method. The dissipative bracket can be considered like an option, within a façade design method based on the simultaneous calculation of the major façade components. The approach is shown in FIG. 4 and it differs from the state of the art sequential method, in which the glass selection is conducted by means of rigid support assumption, neglecting deformability of the frame. This approach generally results in an uneconomical design solution, as the effective structural behaviour of the glazing and its capacity is not calculated as being coupled with the actual framing members. This means that for the same glass, when coupled with a more deformable frame, it is capable of resisting higher level blast threats, as it takes advantage of the energy dissipation contribution of the frame. This effect is considered within a balanced design approach, starting from the glazing designed for conventional non blast loads and then structurally sizing the frame accordingly until it complies with the required protection performance.

Figure 5A:
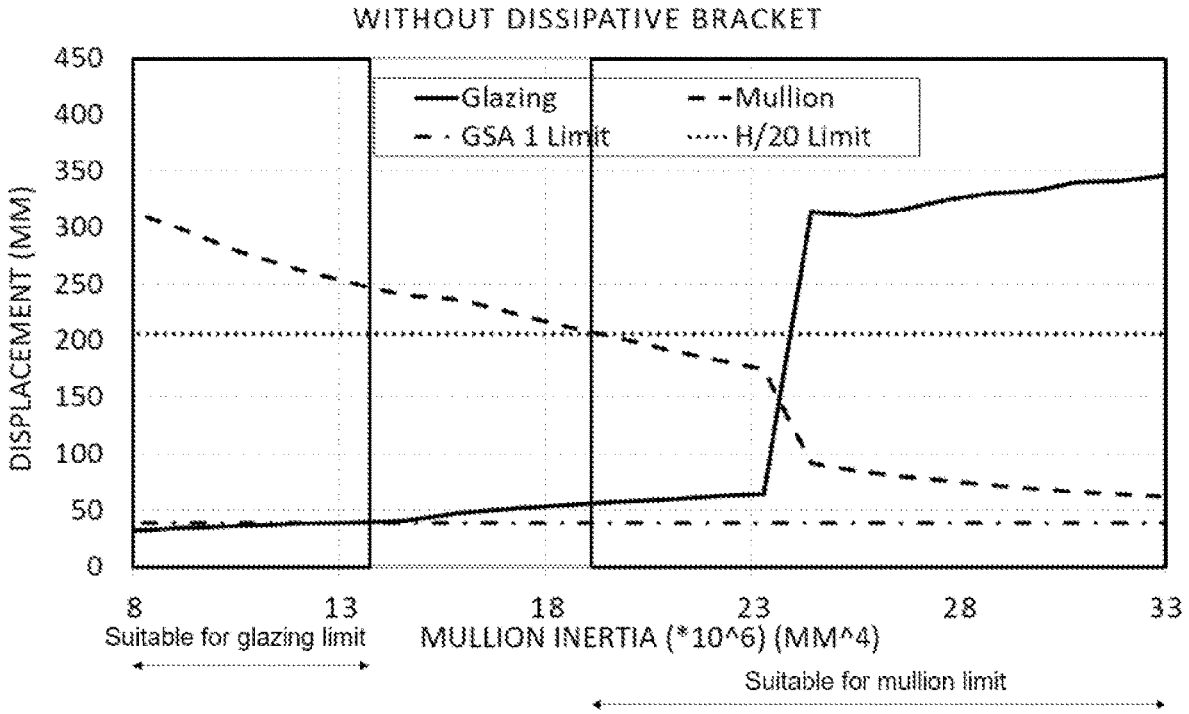
FIGS. 5A and 5B show charts with curves representing the glass and frame as a function of mullion inertia, with and without the novel anchoring system.
Figure 5B:
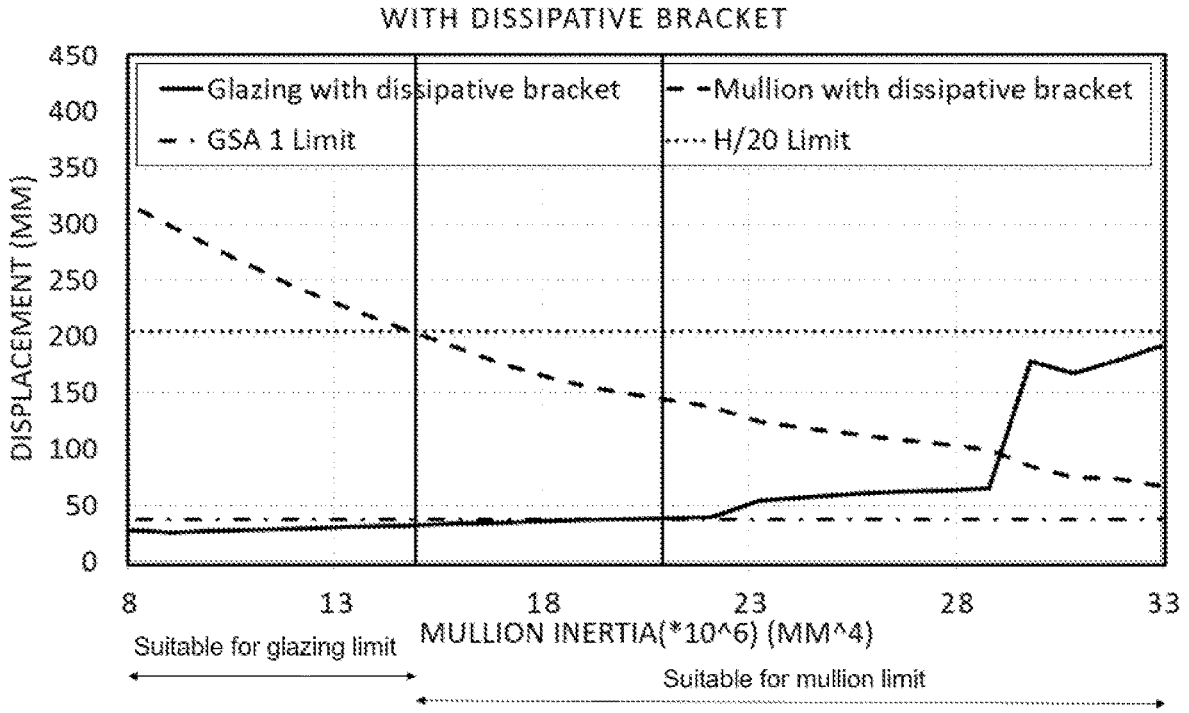
Figure 6:
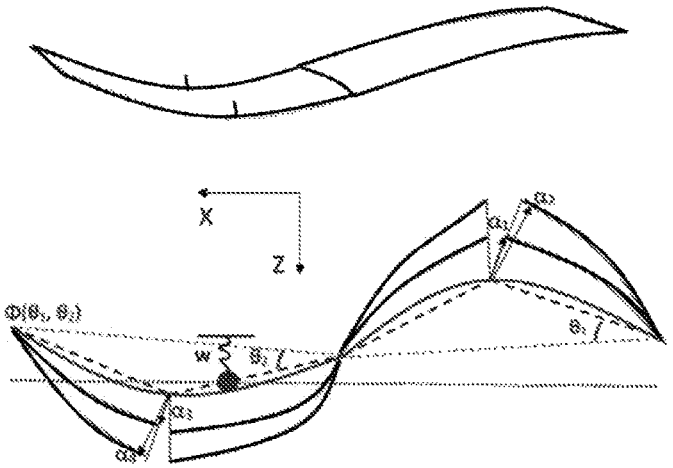
FIG. 6 shows a multiple-degrees-of-freedom model for the dynamic analysis of the major façade components.

An important element for the application of the balanced method is the balanced chart, in which the glass and frame responses are represented, under the design blast load and using a specified glass configuration coupled with varying frame inertias. This scenario is shown in FIG. 5A and it must be seen in conjunction with the flowchart 4, representing the balanced design method (flowchart on the right side). Glazing is selected in accordance with regards to standard façade performance requirements such as wind loads etc glass displacements are plotted for varying mullion frame inertias, as represented by the continuous and dashed lines (FIG. 5A on the top). The suitable inertia range for the design can be derived by means of plotting the intersection of the inertia range that is in compliance with the glass performance requirements (left part of the chart in FIG. 5B) as well as the range that allows frame performance compliance (right side of the chart in FIG. 5B). If no solutions exist within the represented glass configuration relating to the graph, then no solution is found to exist, the glazing configuration must be enhanced and another balanced chart derived, iterating the procedure until a valid intersection range for the inertia (satisfying both glass and framing deflection requirements) is found. Under this scenario however, the integration of a dissipative bracket in the form of the invention can be beneficial and sufficient to define a design solution, without the need to enhance the glazing thickness. The scenario is shown on FIG. 5B, describing the system with the minimum glazing thickness at the top of the chart, but also deriving an additional curve that describes the response of the framing and glazing with the integration of the dissipative bracket for each possible frame inertia. The displacement plots therefore are shifted, allowing an intersection between the design area for glazing and frame. With this example it is shown that the dissipative bracket extends the system options suitable to respond to certain performance requirements, with the advantage of amore economical and/or safer design solution compared with the traditional method; which on the contrary can only achieve the performance requirements by means of enhancing the glazing thickness. A simultaneous calculation approach requires an iterative procedure, as many options should be checked by varying the design parameters and performing a sensitivity analysis in order to ensure that a robust design solution exists. For this reason a MDOF, Multi Degrees of Freedom model, seems the ideal numerical model to be included in the balanced design approach, as it is sufficiently accurate to evaluate the behavior of the major façade elements, but without the need to undertake time consuming analysis with large number of degrees of freedom typical of the finite element analysis. In practice each major façade component (glass, frame, bracket) is represented by only a SDOF (Single Degree of Freedom), and in turn coupled simultaneously to model the real geometric and material behavior of the façade components.

Figure 9:
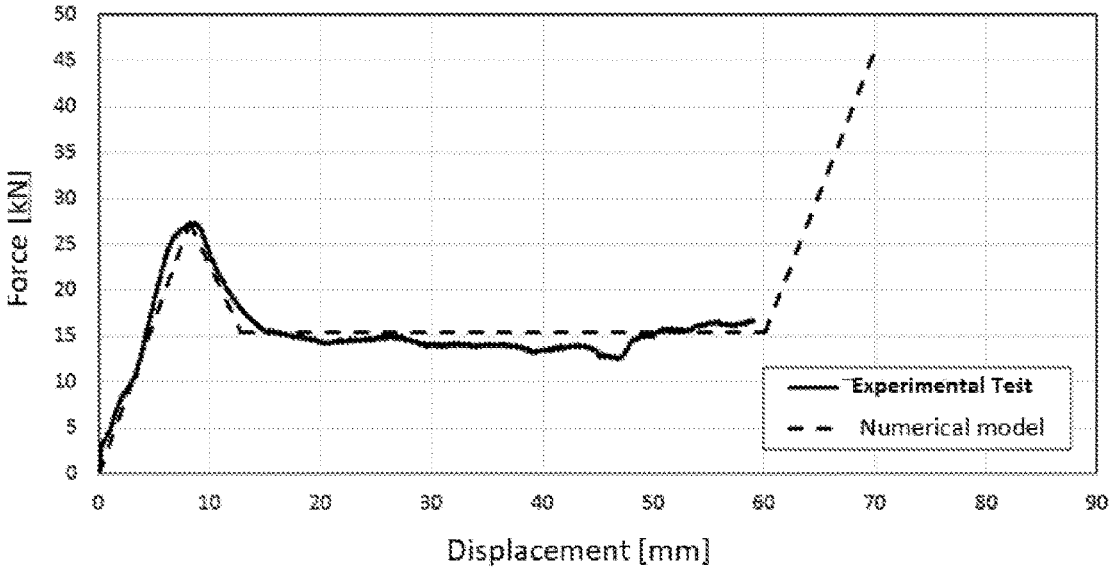
FIG. 9 shows a chart comparing curves representing the experimental and the numerical behavior of the resistance function versus displacement for an anchoring system of the invention
Figure 10:
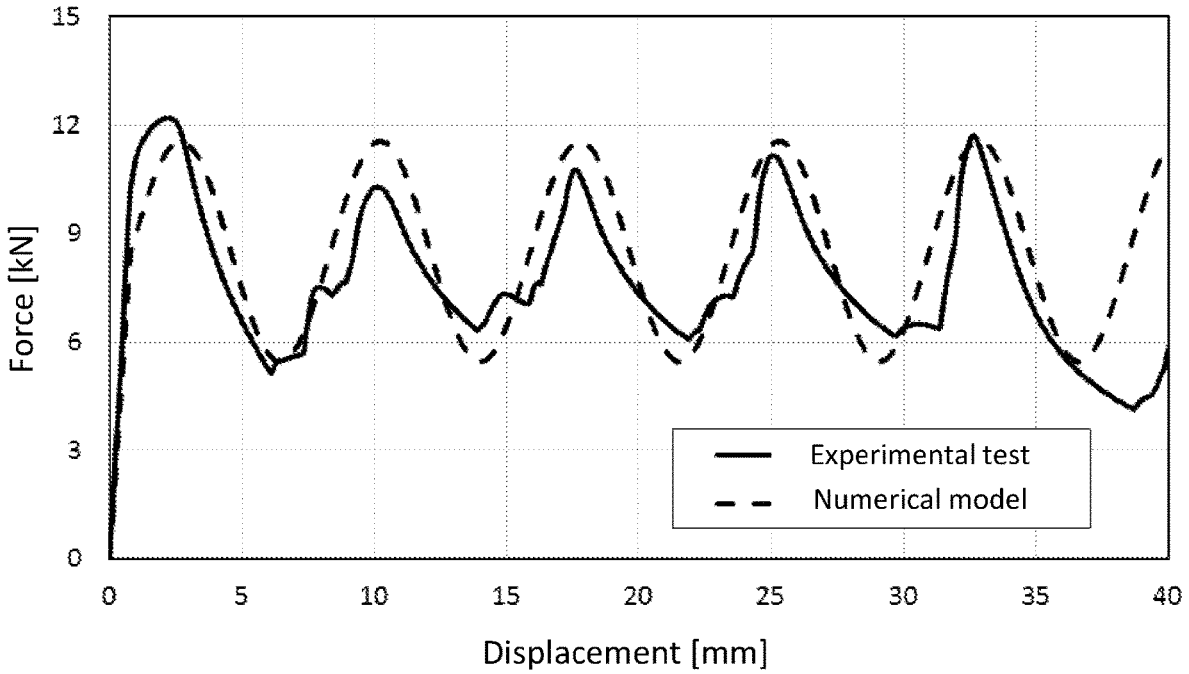
FIG. 10 shows a chart comparing the experimental and numerical behavior of the resistance function versus displacement for a dissipative element to be adopted in the anchoring system of the invention FIG. 11 outlines a chart with the general resistance function for an anchoring system integrating lightweight concrete reinforcement, FIG. 12 describes experimental literature with regards to various instability types of aluminium tube as a function of diameter, length and tube thickness, FIG. 13 lists experimental results for three different tube specimens of identical dimensions, subject to a compression test that excites the Eulerian instability type.

We describe here one preferred design method for the anchoring system according to the invention. Given the target resistance versus deformation function output of the balanced design method, a certain combination of dissipative elements can be chosen in order to obtain a resistance function behavior as close as possible to the target function. The FIGS. 9 and 10 for instance show resistance versus deformation functions for aluminium foam and for compressed aluminum tubes. By means of an experimental database or analytical functions, the behavior of a single dissipative component can be simulated and finally the superimposition of more elements in series or parallel can be assessed. For instance the adoption of pins 29 is important to offer redundancy of safety with respect to traditional loads and also small gaps between the elements become fundamental to apply phase difference between the peaks of the single resistance functions, in the way that the final plateau is as smooth as possible and close to the ideal condition.

Figure 11:
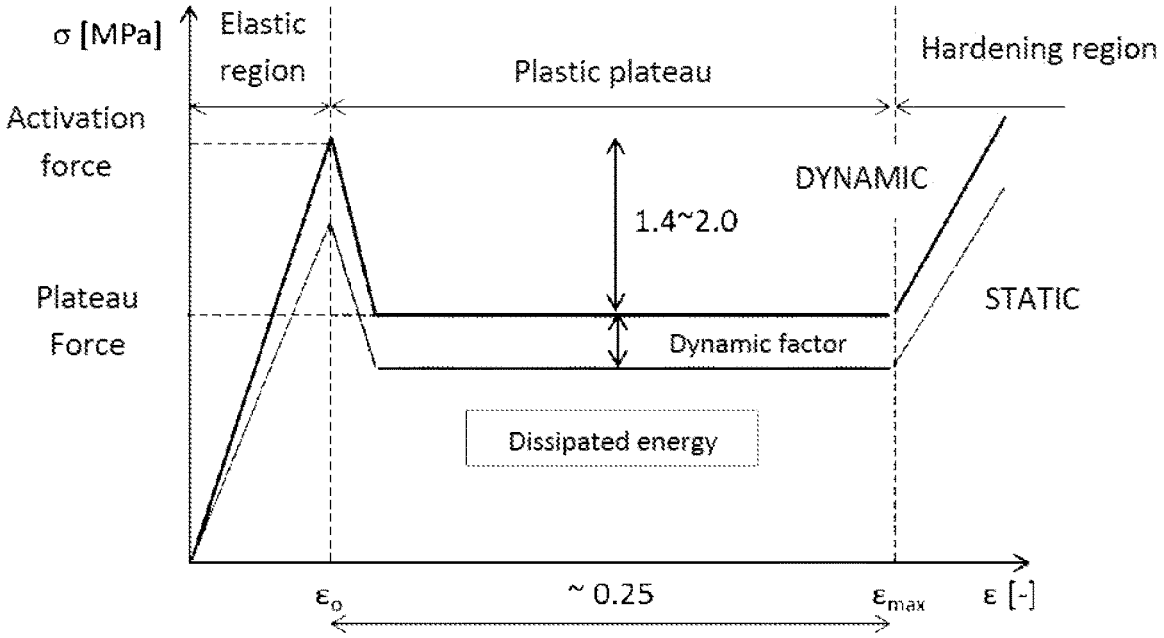
Figure 12:
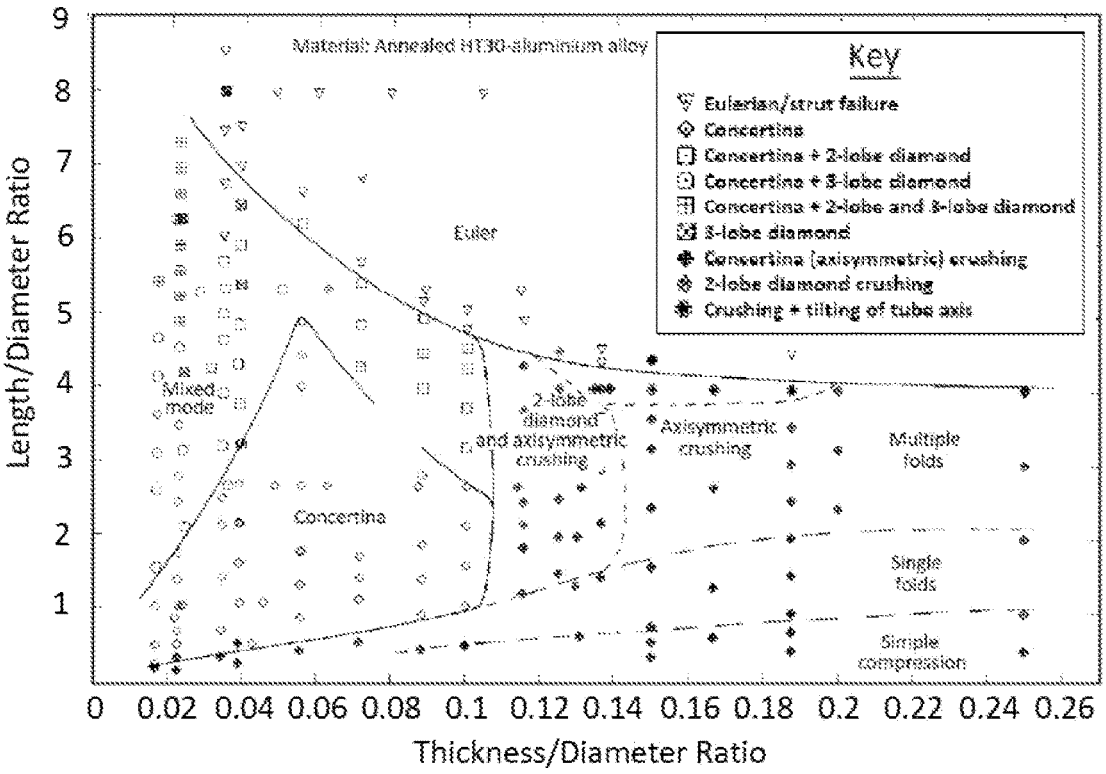
Figure 13:
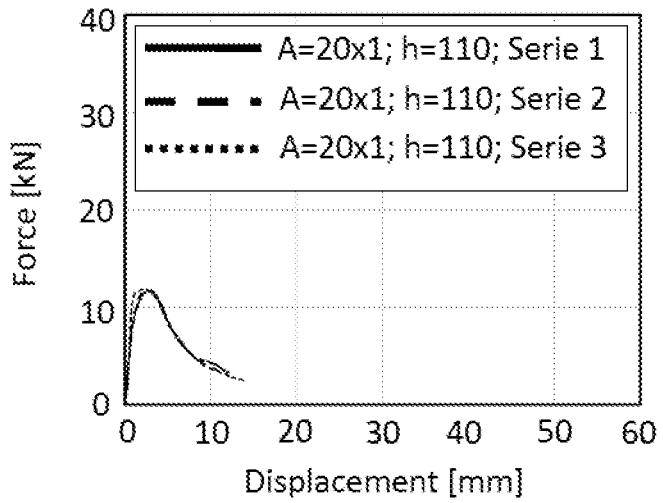

FIG. 11 shows a generic description of the resistance function for a dissipative element, with typical characteristics of a lightweight concrete element 16: described are the elastic region, the activation force (in general larger than the plateau force), hardening that follows the effective plateau and the presence of high strain rate factors, which however are not present when quasi-static tests are performed. For this reason it is recommended to conduct both static and dynamic tests in order to build a record for a database of dissipative elements. It is obviously suggested to search for an experimental confirmation even when literature data exist with regards to particular dissipative elements or material. For instance FIG. 12 shows the well-known diagram that establishes the occurrence of the different types of instability (Eulerian, concertina-mode, diamond-mode, mixed-mode) when aluminium tubes are compressed. In particular it is convenient to use diameters, length and thicknesses that are characterized by the activation of local modes (concertina, diamond, mixed) as they form a longer plateau with major control of the reaction and the energy dissipation. On the contrary, the activation of a global Eulerian mode gives a sudden drop of the resistance, which would not be suitable to calibrate the dissipative effect by means of the anchoring system. For this purpose the difference in behavior between the tube in FIG. 10 (concertina mode) and FIG. 13 (eulerian) is clear. The elements with behavior like FIG. 13 should be used only in combination with other dissipative elements, as they must provide the lateral stability, avoiding global instability from occurring. For instance, lateral stability is the main role of the central aluminium foam 6 used in some design solutions, like for instance that shown in FIG. 7. While the optimal methodology that permits the customization of the anchoring system on the basis of a specific design request has been already described, other standardized alternative solutions for the anchoring system are now explained.

One first alternative embodiment has been developed in order to respond to low level blast threats and it is also defined as first level of threat dissipative bracket.

Figure 14:
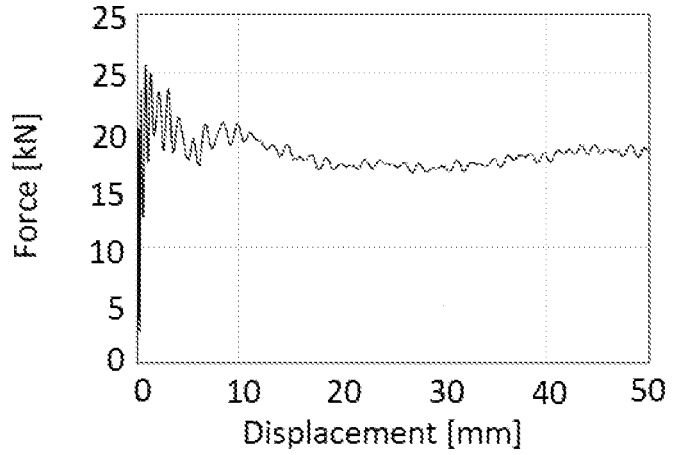
FIG. 14 shows an experimental resistance versus displacement curve under high strain rate behavior for a bracket designed to resist mid level magnitude blast loads.

This definition comes from the fact that it can be applied to a conventional façade with traditional glass, frame and connections and in this way the façade will be significantly upgraded in terms of its blast resistance. The plateau of the FIG. 14 is around 20 kN and the anchoring system can be deformed inward of about 60 mm and outward of around 20 mm. The dissipative elements are aluminium tubes with 10 mm diameter and 1 mm thickness, in combination with aluminum foam.

Figure 15:
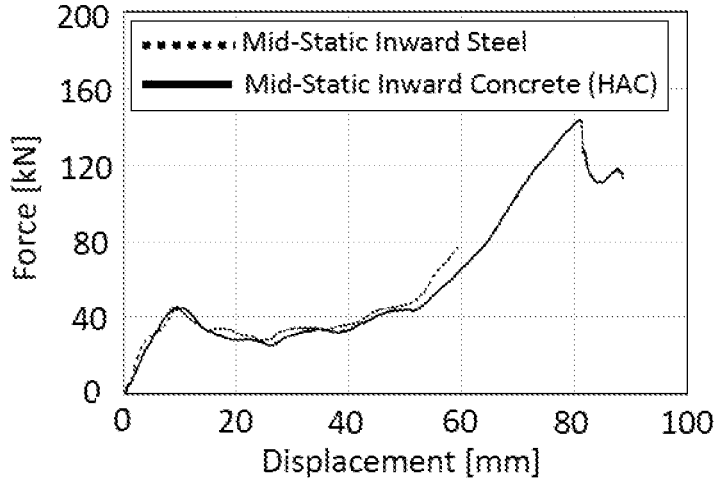
FIG. 15 shows typical resistance versus displacement curves under quasi-static behavior for a bracket designed to resist mid level magnitude blast loads.

In FIG. 15 there is no real plateau in the resistance versus deformation curve, due to the behaviour of the lightweight concrete. On the contrary the function of the resistance is increasing in the effective range of dissipation. The equivalent plateau is in this case around 40 kN, still making use of maximum allowable 60 mm of inward deformation and 20 mm of outward deformation.

Figure 21:
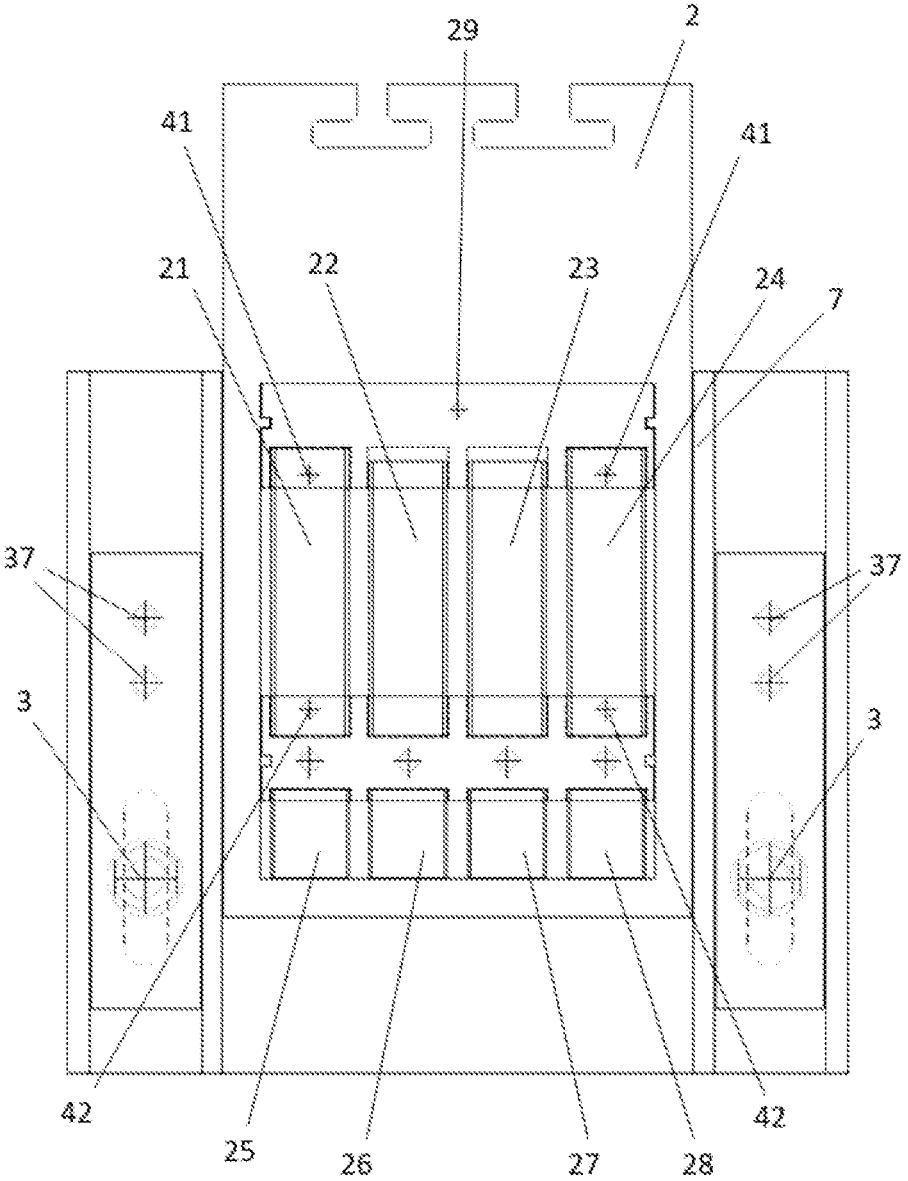
FIG. 21 shows an embodiment of the anchoring system; suitable for high level design loads.

Another form of realization of the anchoring system, suitable for high blast loads, is shown in FIG. 21. The high blast load dissipative bracket is obtained by combining multiple tubes, designed in order to collapse according to the local modes of instability and using the phase difference principle between the single resistance function peaks. Under this scenario, the plateau is around 120 kN and this bracket can be adopted for situations where the reaction peak of the rigid bracket is not greater than 300 kN.

It can be concluded that by means of the invention anchoring system, an energy transfer from the glass and frame to the bracket can be achieved. Under the same conditions of blast threat and façade system resulting in higher protection performance for these elements, as they will be characterized by a lower state of stress, once the plastic deformation of the bracket is activated. Or, in alternative way, the dissipative bracket can be used in order to optimize the design towards a more economical and sustainable solution, preserving the same performance. The scenario is according to the FIG. 3: the left side is typical of the state of the art anchoring system having rigid behavior, while the glass response undergoes post-cracking behavior and activates the laminated glass PVB interlayer phase. On the contrary, the anchoring system of the invention absorbs part of the blast wave energy by means of permanent plastic deformation, while the glass deformation is reduced; the glass remains uncracked, with no subsequent fragmentation hazards. However this approach should be seen by looking in general sense to the dynamic interactions, as the dissipative bracket behavior is only a further integration into the well-known mechanism of glass-frame interaction. Then, also this further design optimization should be conducted by means of an appropriate method to simultaneously evaluate the dynamic behavior of bracket, frame and glazing.

Figure 2:
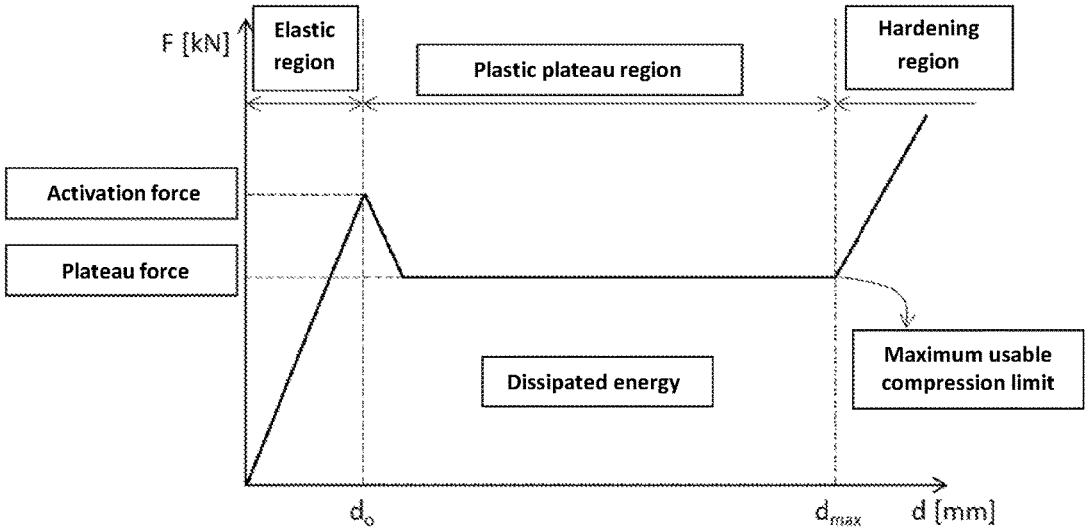
FIG. 2 shows a chart with the ideal resistance function versus the deformation of one version of the invention.

A dissipative element, to be used in the anchoring system of the invention, should have the following characteristics:

- Behavior in tension and/or compression similar to what shown in FIG. 2
- Elastic region characterized by sufficient stiffness to avoid an excessive elastic deformation under conventional non blast loads
- Presence of a perfect plastic plateau, with negligible hardening and lasting for at least 30-40% of strain
- Negligible drop of resistance between activation force of the dissipative bracket and the force at the plateau
- Reduced statistical scatter of the parameters in FIG. 2, in particular of the plateau resistance
- Reduced statistical scatter of the high strain rate factor
- High strain rate factor stable in a wide range of strain rate, suitable for typical applications With regard to the plastic behavior, it should match the plastic plateau in FIG. 2. In this sense the metal tubes under local compression are preferable (concertina, diamond, mixed), as they give a precise activation force without significant statistical scatter and a stable plateau for more than 50% of strain. For this purpose, reference is made to table 1, which shows the properties, strengths and weaknesses of some elements under experimental laboratory testing, in quasi-static and dynamic strain rate.

TABLE 1

Characteristics of several dissipative elements

| | Resistance type | Effective deformation | Weaknesses | Statistical scatter | Dynamic effects |
|---|---|---|---|---|---|
| Tubes in compression (steel) | To low to high in function of the thickness | High | Eulerian instability, high peak of transition | Negligible | Positive |
| Tubes in compression (aluminium alloy) | To low to high in function of the thickness | High | Eulerian instability, high peak of transition | Negligible | Positive |
| Tubes in compression (Glass fiber reinforced polymers) | To low to mid in function of the thickness | High | Eulerian instability | Low | Significant |
| Aluminium foam | Generally low. Option to adopt silicon alloys to augment resistance | Mid | Low resistance per surface unit | Generally low. It increases by more resistant alloys (silicon alloy) | Negligible |
| Lightweight concrete | Mid-high, extremely variable by density | Mid | High peak of transition, extreme variability | High | Negligible |

Figure 16:
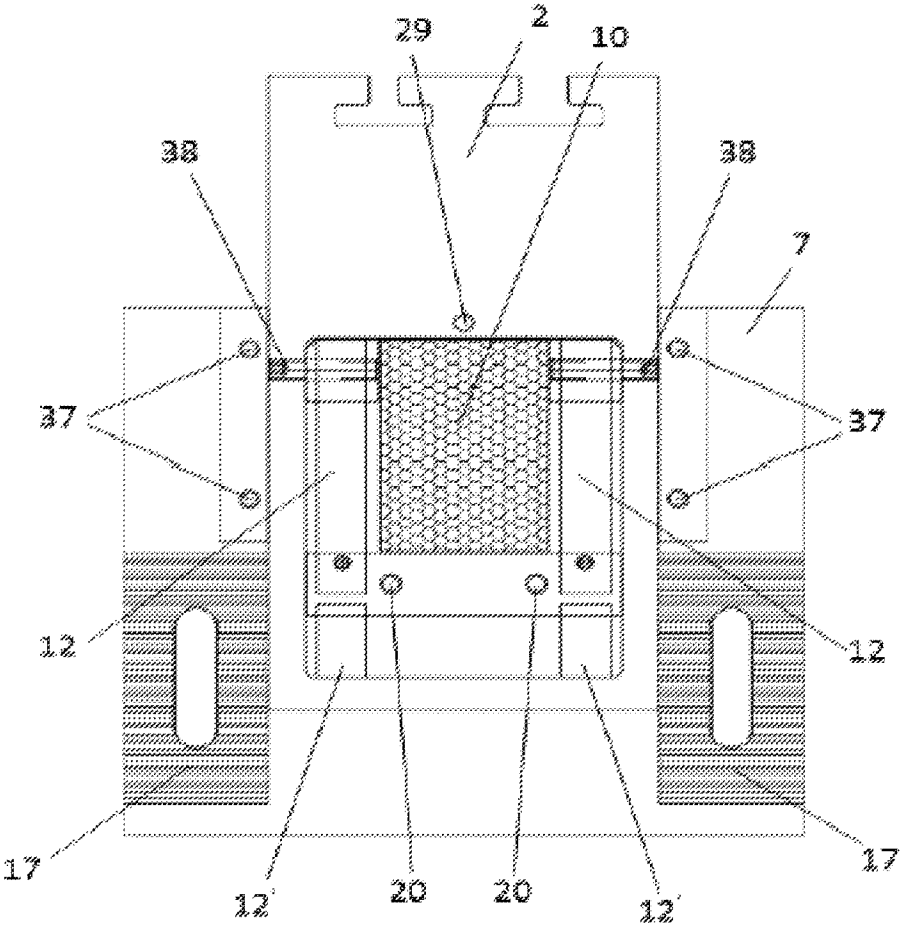
FIG. 16 shows a design solution for the invention anchoring type.

The experimental testing has shown that some elements can be used with a dual function within the overall behavior of the anchoring system. For instance, materials with low compression strength (normalized to the surface of compression) can be adopted as lateral stabilization elements. As shown in FIG. 16 for instance, the central aluminium foam 10 provides only a small part of the overall resistance function, contributing no more than 10-15% of the plastic plateau, but ensures that the aluminium tubes 12 under compression are stable, without undergoing global buckling. Indeed, in order to have cost-effective designs, there are constraints for the bracket dimensions and there is the need to adopt slender tubes (high value L/D), which generally excite eulerian instability (FIG. 12). However, the lateral stabilization of the foam 10, added to the other one exerted by the box surfaces, has been proven effective under experimental tests for elements with critical L/D ratios: the foam contributes to the activation of the preferable instability (local) mode.

By experimental tests it has been noted that the high strain rate has also a beneficial effect from this perspective, making possible the activation of the local instability under those scenarios characterized by eulerian instability under quasi-static equivalent test.

As the anchoring system dissipative principle is applied by means of slips between surfaces in contact, friction due to the dead load and other actions in the vertical direction (like bolt 3 preload of the anchoring system to the cast in channel 4) need to be properly accounted in the resistance function.

However, it must be noted that this type of action has a large degree of variability and then it is more effective to try to limit as much as possible its impact on the resistance function. The best strategy within this scope consists of the integration of low friction material foils (like Teflon, friction coefficient Teflon-Aluminium=0.15) between the surfaces. It must be also considered like in the transition between static friction to dynamic friction, two contributions are added to the resistance function, the first one acting on the activation force (static friction) and the second on the plateau (dynamic friction).

Another element that can be effective in the invention design is springs 13, which are not dissipative elements, as they exhibit elastic behavior. However, their benefits to the invention are:

- They contribute to the resistance function, even if by means of elastic component, by linear dependence on the deformation
- They can restore the initial equilibrium position of the façade after the blast event, by exceeding the friction occurring on the dissipative bracket at the end of the dynamic façade response because of the façade dead load.

Figure 17:
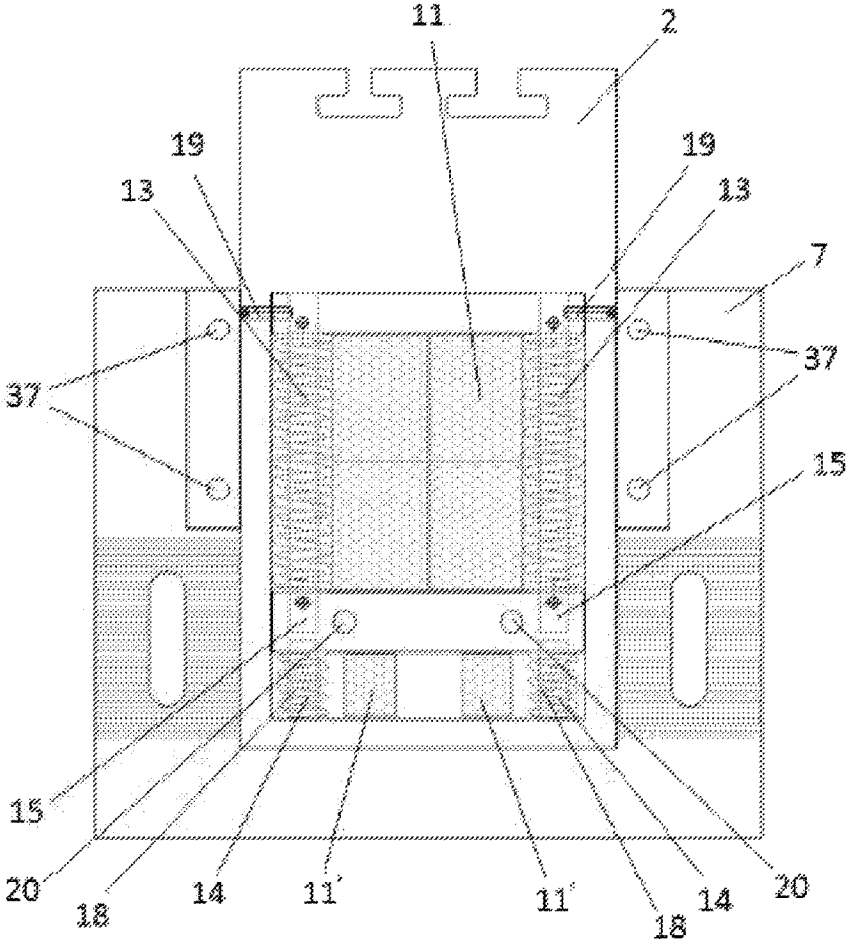
FIG. 17 shows another (alternate) design solution for the invention anchoring type.

In FIG. 17 there is shown how springs 13 and 14 can be located in a typical layout of the anchoring system, for instance by placing them around the dissipative tubes 15 and 18. In this case the internal diameter of the spring 13 is large enough to allow the tube 15 to deform according to the local instability shape, as at the end its external diameter will be around 20% larger than the undeformed shape. The same figure shows also the dissipative elements 11 and 11' made by aluminium foam and designed according to the resistance function demand.

Machining 17 can be executed on the box 7 at the slots, in order to manage dimensional tolerances, in order to allow fixing with washers. The threaded pins 19 and 38 can be used instead of pins in order to realize a removable connection.

Figure 18:
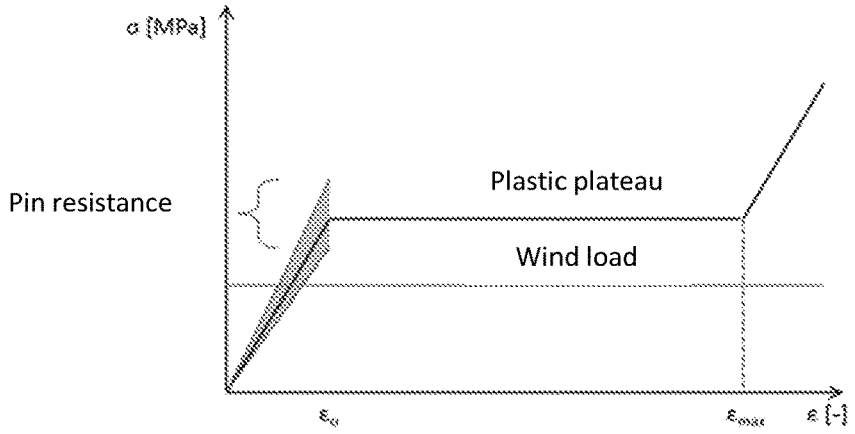
FIG. 18 shows a chart that explains the design method for a fuse pin to be integrated into the anchoring system.
Figure 20:
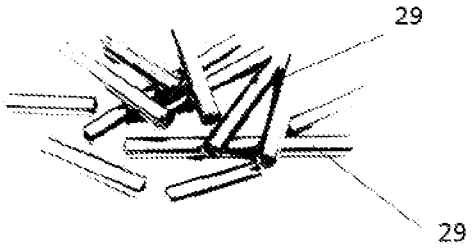
FIG. 20 shows the fuse pins used as components integrated into the anchoring system of the invention.

In FIG. 18 a scheme is shown, with the scope to highlight the need for safety with regards to the activation of the plastic behavior with respect to the maximum design wind load. The safety factor must be provided in relation to the statistical scatter of the pin 29. The use of pin 29, for instance of the type show in FIG. 20, placed between the surfaces 21 movable and fixed of the anchoring system, is beneficial because of two reasons:

It provides redundancy with respect to the wind load resistance and other non-blast conventional loads, It eliminates the risk for excessive elastic deformations due to small total stiffness in the elastic phase of the anchoring system However, it must be noted that the resistance of the pins 29 is superimposed to that one of the dissipative elements, postponing the activation of the dissipative principle.

Moreover, under some scenarios like for instance when the peak reaction is relatively low, it seems beneficial to adopt indented pins, in order to favor a more precise and not scattered activation. At the same time, in order to reduce the impact of the pin strength on the overall resistance function, a gap should be considered for the activation of the dissipative elements, designed on the basis of the maximum deformation expected for the pin at failure, generally of order of magnitude of 10 mm.

Summarizing, the beneficial characteristics of the overall resistance function for the anchoring system of the invention are:

- Elastic deformation control under conventional loads (both in inward and outward building direction) by means of components with reduced elastic deformation and/or use of pins and rigid system redundancies to the forces due to the wind load
- Precision and reduced scatter of the activation force system, generally by means of pins, as described at the previous item. A time gap can be applied to the dissipative elements with respect to the pin failure, in order to achieve a phase difference between the peak pin strength occurrence and plastic plateau.
- Reduced scatter, sufficient available strain and control of the plastic plateau
- Hardening phase at the end of the effective deformation; resulting in a kind of "break" to an excessive displacement of the façade, avoiding the risk of impact of the façade itself against the slab.
- Restore of the equilibrium position driven by residual resistance of the elements in tension
- Activation of a dissipative effect in outward direction, in order to limit by a plastic plateau also the forces to the connections in the outward building direction. The principle is the same as for the inward direction, but in general a smaller deformation is required, because the impact of the dynamic rebound of the façade is less intense than the inward impulse given by the positive phase of the blast wave.
- Optional elastic system for restoring the initial bracket position as equilibrium position after the blast event.

Figure 19:
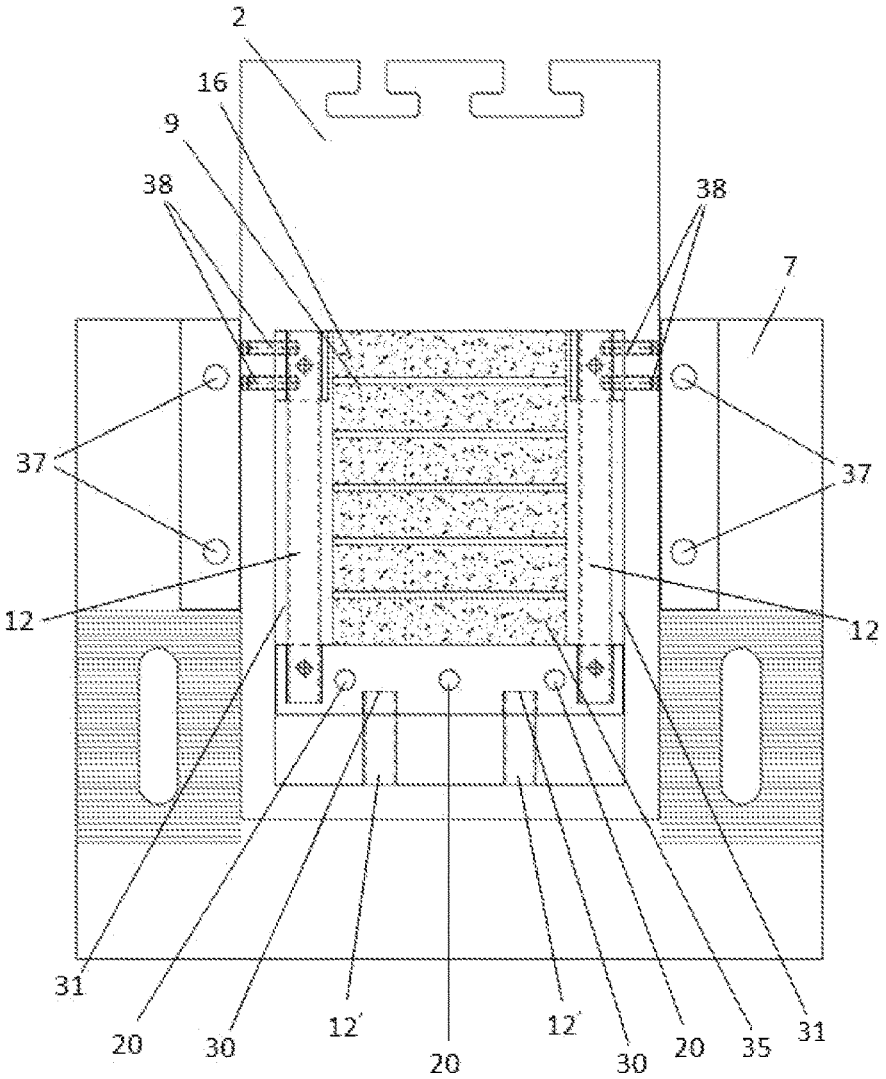
FIG. 19 shows an embodiment of the invention.

The FIG. 19 shows a further alternative design solution of mid resistance for the anchoring system, which makes use of lightweight concrete bars 16, optionally separated by metal shims 9 of metal or other adequate material, like dissipative elements 35. In the same figure, the rooms 30 for the integration of tubes 12' are visible, optionally glued in order to avoid the tubes 12' move out of their position during the inward compression and then would be not anymore compressed during the rebound phase. The gap 31 allows that the tube 12 can deform under the local instability of concertina or diamond or mixed type. The FIG. 21 shows another alternative embodiment of the anchoring system of the invention with the four tubes 21, 22, 23 and 24 in which the tubes 22 and 23 have a gap of few mm with respect to the other two tubes 21 and 24, in the way that the occurrence of the instability waves occur with a phase difference and then a more flat plateau is obtained. The same principle can be applied to the tubes 25, 26, 27 and 28, which are compressed during the rebound phase. The pins 41, together with the 42 on the other tube side, permit a resistance also during the elastic rebound subsequent to the maximum inward compression.

Figure 22:
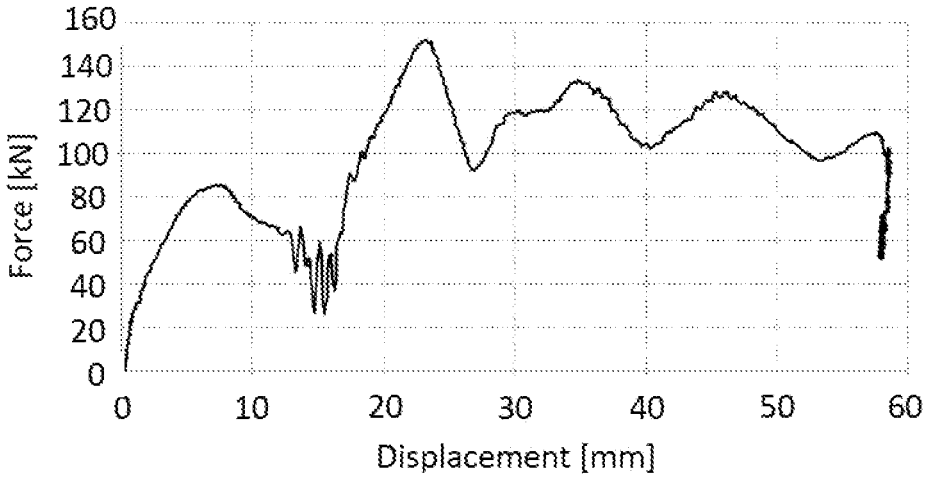
FIG. 22 shows a resistance function derived by loading the anchoring system in the inward direction.
Figure 23:
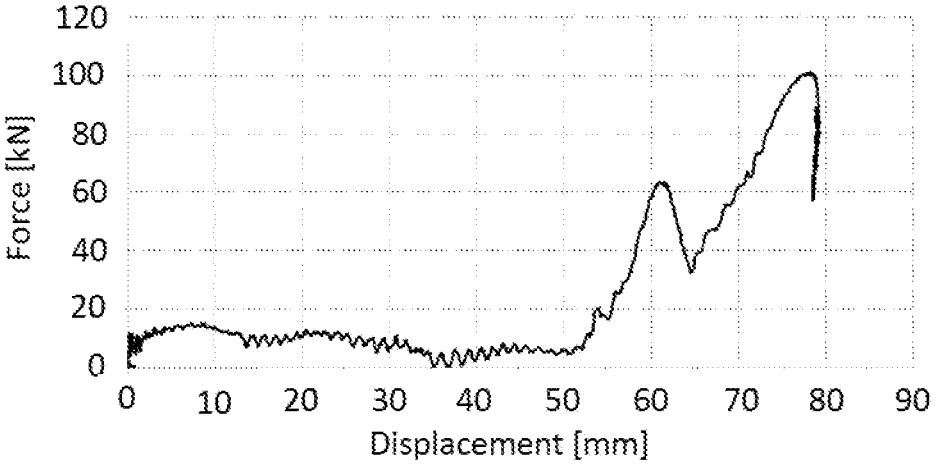
FIG. 23 shows a resistance function derived by loading the anchoring system in outward direction.
Figure 24:
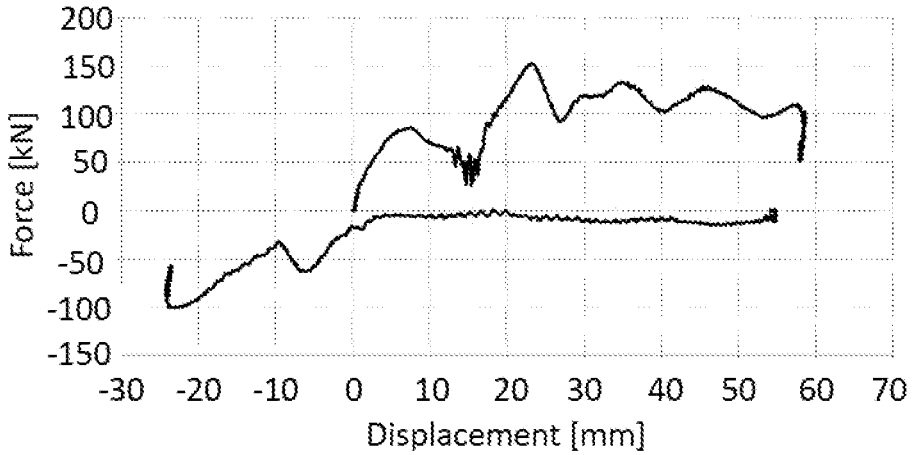
FIG. 24 shows a resistance versus deformation path that the anchoring system performs under a blast load.

One example of experimental results obtained by means of static or dynamic tests on a dissipative bracket according to the invention are shown in the FIGS. 22, 23 and 24. The FIG. 22 shows a resistance function obtained by compressing the anchoring system in inward direction. There is visible an initial phase of around 15 mm where the pin is resisting until the pin fails at a resistance of around 80 kN. When the pin is broken, the tubes start to be compressed until a plateau of 40 mm length at 120 kN is formed. As it can be seen, the first sine wave of the tube local instability produces a peak of around 150 kN. In order to further smooth the difference between peak and mean value, the phase difference between the tubes can be optimized. The FIG. 23 shows instead the outward compression experimental curve. The experimental test is conducted in the outward direction by starting from the final position obtained during the inward test. This means that the origin of the abscissas onto the FIG. 24 is coincident with the maximum displacement value of the chart in FIG. 23. It can be noted that a small resistance is available (with small drops due to the collapse of the pinned tubes 21, 22, 23 and 24), until the tubes 25, 26, 27 and 28 are compressed. At that point, again with the phase difference achieved by means of the relative tube gaps, the outward plateau resistance is available.

FIG. 24 combines the two previous figures: it shows the actual path merging the two phases. The chart provides the continuous path resistance versus displacements that the bracket follows during the blast wave loading: the hysteresis cycle identified will be representative of the dissipated energy.

Given a specific typology of dissipative bracket, it would be possible to make an analytical simulation of its resistance function by means of the component single element resistance superimposition and their relative phase difference.

The following parameters have been used to characterize the analytical model of the single element:

- Phase difference between initial compression of the elements and initial compression of the overall system (mm)
- Elastic stiffness (kN/mm)
- Nominal value and scatter of the activation force (N)
- Length of the average plastic plateau (mm)
- Slope of the average plastic plateau (for lightweight concrete)
- Alternate component amplitude (kN)
- Wavelength of the alternate component (mm)
- Residual resistance in tension (for pinned tubes, kN/mm)
- Linear stiffness (for springs, kN/mm)
- Friction component (constant in kN)

The analytical model provides the global resistance versus deformation function of the bracket in both inward and outward direction, once the several components are superimposed.

It is possible to select some values of global design resistance for the dissipative bracket of invention and to define standard alternative layouts.

Table 2 With Standard Design Layouts

| Resistance level | Pin | Inward Peak [kN] | Outward Peak [kN] | Inward displacement [mm] | Outward displacement [mm] |
|---|---|---|---|---|---|
| First | No | 27 | 18 | 60 | 25 |
| First | No | 33 | 25 | 60 | 25 |
| First | No | 35 | 32 | 60 | 25 |
| First | No | 43 | 32 | 60 | 25 |

-continued

| Resistance level | Pin | Inward Peak [kN] | Outward Peak [kN] | Inward displacement [mm] | Outward displacement [mm] |
|---|---|---|---|---|---|
| First | Yes | 27 | 18 | 60 | 25 |
| First | Yes | 33 | 25 | 60 | 25 |
| First | Yes | 35 | 32 | 60 | 25 |
| First | Yes | 43 | 32 | 60 | 25 |
| Mid | Yes | 50 | 50 | 60 | 25 |
| Mid | Yes | 70 | 70 | 60 | 25 |
| Mid | Yes | 90 | 90 | 60 | 25 |
| High | Yes | 100 | 100 | 60 | 25 |
| High | Yes | 125 | 125 | 60 | 25 |
| High | Yes | 150 | 150 | 60 | 25 |

Even larger levels of resistance can be obtained, by making use for instance of other smaller tubes inside the already existing ones. The standard layouts can cover a wide range of applicative conditions: the variability of the anchoring system for low resistance depends on the fact that this typology applies in strict coordination with the wind load design. The dissipative principle should be activated in precise way and the different design solutions depends on the wide range of applications for the maximum wind load, because of variability of maximum design wind pressure, wind suction and unit facade surface. By means of the anchoring system at 150 kN plateau it is possible to cover situations with rigid peak around 350/400 kN, assuming a 60% reduction of the peak. This maximum plateau seems to cover most part of the applicative cases.

Figure 43:
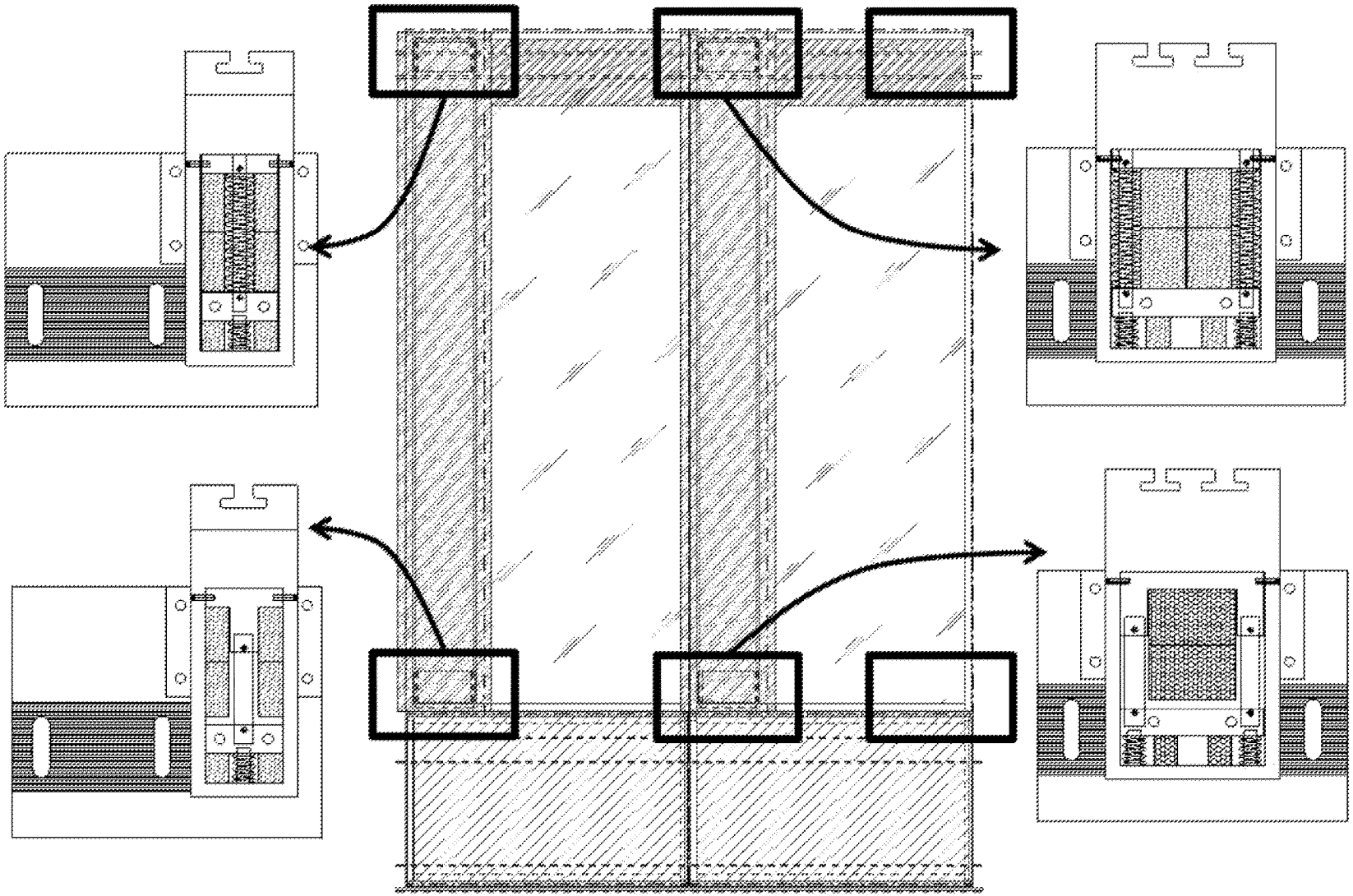
FIG. 43 shows the partial elevation of a building used for the simulations of the benefits derived by the application of the invention anchoring system

One example of calculation for one building façade with panels 8 is shown in FIG. 43. Different types of embodiments of the invention are applied in the example.

Example of Application

For a better understanding of the invention, here we describe an example of embodiment including an anchoring system of the invention.

A twenty-floor building formed by a podium of eight floors and a tower of twelve floors must be designed to resist a threat equivalent to an explosion of 100 kgTNT. The minimum distance of the different facades from the threat is assumed of 15 m for the four elevations.

The computational fluid-dynamic analysis of the blast wave propagation has determined the following design peak pressure values and impulse at the different building floors, according to the following table 3.

TABLE 3

Design blast loads for the different building floors

| Floor | Pressure [kPa] | Impulse [kPa · ms] | Facade Unit |
|---|---|---|---|
| 1 | 272 | 955 | 1500 × 4800 |
| 2 | 248 | 896 | 1500 × 4800 |
| 3 | 197 | 761 | 1500 × 4800 |
| 4 | 149 | 621 | 1500 × 4800 |
| 5 | 135 | 507 | 1500 × 4800 |
| 6 | 118 | 420 | 1500 × 4800 |
| 7 | 88 | 354 | 1500 × 4800 |
| 8 | 69 | 305 | 1500 × 4800 |
| 9 | 57 | 265 | 1500 × 4000 |
| 10 | 46 | 234 | 1500 × 4000 |
| 11 | 39 | 209 | 1500 × 4000 |
| 12 | 33 | 189 | 1500 × 4000 |
| 13 | 29 | 172 | 1500 × 4000 |
| 14 | 25 | 157 | 1500 × 4000 |

TABLE 3-continued

| Design blast loads for the different building floors | | | |
|---|---|---|---|
| Floor | Pressure [kPa] | Impulse [kPa · ms] | Facade Unit |
| 15 | 22 | 145 | 1500 × 4000 |
| 16 | 20 | 134 | 1500 × 4000 |
| 17 | 18 | 125 | 1500 × 4000 |
| 18 | 17 | 117 | 1500 × 4000 |
| 19 | 15 | 110 | 1500 × 4000 |
| 20 | 14 | 104 | 1500 × 4000 |

The typical façade module is 1500×4800 mm at the podium area (floors 1-8) and 1500×4000 mm at the tower area. Under this scenario the adopted solutions are:

Dissipative bracket of type 1 at floors 1-4

Dissipative bracket of type 2 at floors 5-8

Dissipative bracket of type 3 at floors 9-20

Figure 25A:
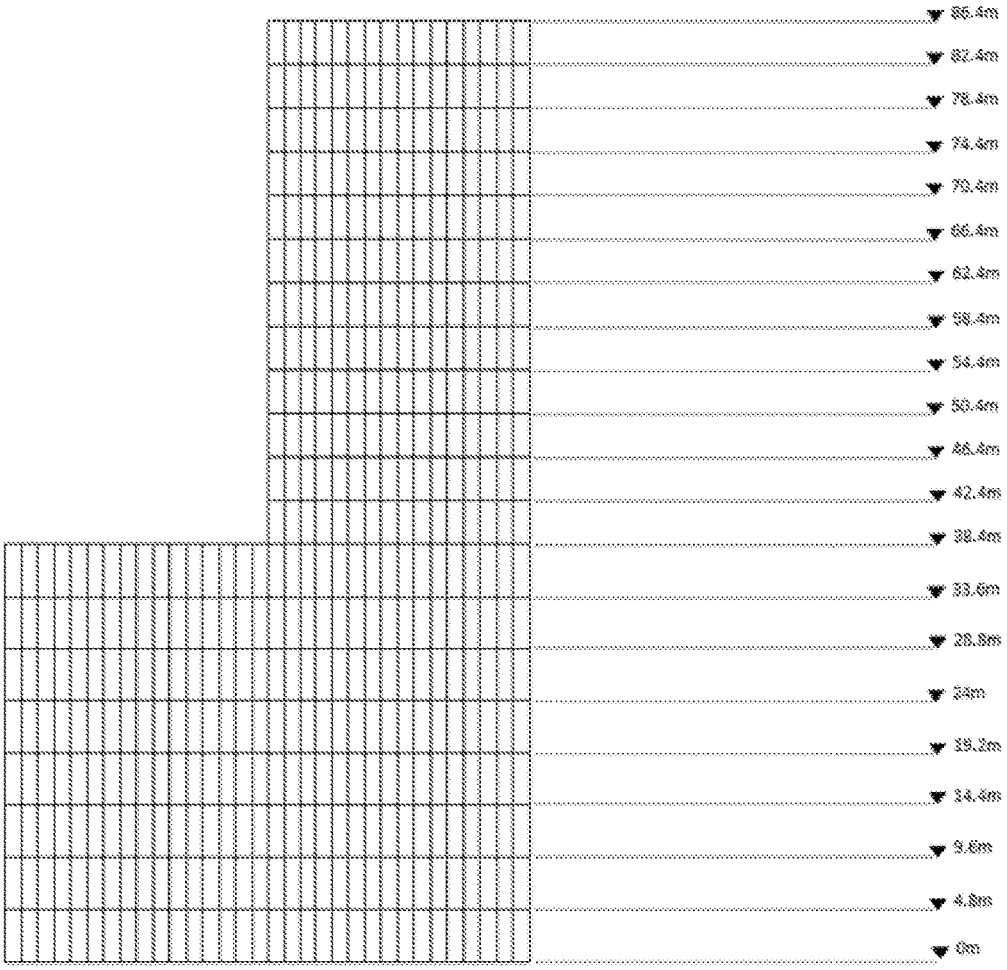
FIG. 25 shows a building frame used for a numerical simulation focused on the invention behavior under a blast load.
Figure 25B:
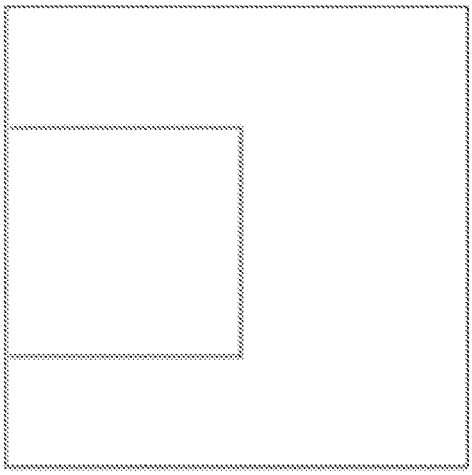

In the FIGS. 25*a* and 25*b* the elevations and the horizontal cross section of the building are shown. In case the dissipative bracket of the invention is adopted, the optimized design of the façade at the different floors will be according to Table 4 shown, by the version in aluminium alloy 6060-T6. The extruded plate 2, machined to allow the engagement of the hooks of the façade bracket, is fixed to the block 33, by means of the connection 32. On the other side the similar connection is provided for the block 34, fixed by 4 bolted connections to the external bracket box, which will be fixed to the slab by the bolts 3, in general adopting cast in channels 4 embedded into the concrete. The blocks 36 are also connected by bolts 37 to the fixed box. The movable part formed by plate 2 and block 33 can be connected to the fixed part by means of the pin 29. Movable and fixed parts are then connected by means of four tubes 39, connected by the pins 41 and 42. The tube 39 are assembled into the coaxial tubes 43 with larger diameter, providing a small gap 45 of few mm with respect to the surface block 33. Finally four tubes 44 are integrated between the back side of the movable plate 2 and the fixed box, inside the holes provided on the blocks 34.

Figure 29:
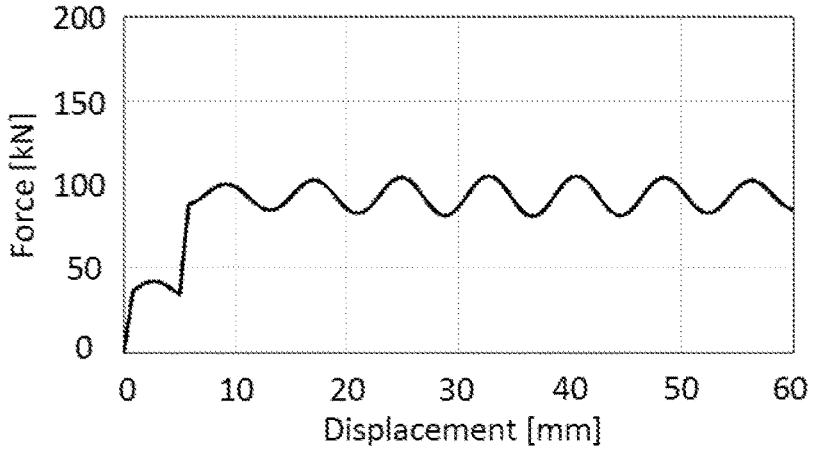
FIG. 29 shows a numerical model for the inward resistance function of the anchoring system of the invention.

The FIG. 29 shows the analytical model of the inward resistance function, simulated by means of the dissipative bracket design tool without adoption of the pin 29.

The function considers the characteristics of the single dissipative elements as per Table 5 and it combines them taking into account the 6 mm gap between the activation of the tube 39 and tube 43 compression.

TABLE 4

| Analysis results in terms of façade design at the different building floors | | | | | | | | | | |
|---|---|---|---|---|---|---|---|---|---|---|
| Impulse [kPa · ms] | Glazing | Mullion | Stiffener | Glazing displacement [mm] | Mullion displacement [mm] | Reaction peak to inward force [kN] | Reaction peak to outward force [kN] | Strengthening of connections | Maximum bracket deformation IN | Maximum bracket deformation OUT |
| 955 | 10HS.16-6.6.4AN | Spadeadam200 | 120 × 8 mm5355 | 322 | 170 | 92 | 46 | | 53 | 19 |
| 896 | 10HS.16-6.6.4AN | Spadeadam200 | 120 × 8 mm5355 | 319 | 151 | 92 | 46 | YES | 47 | 16 |
| 761 | 10HS.16-6.6.4AN | Spadeadam200 | 120 × 8 mm5355 | 311 | 107 | 92 | 46 | YES | 34 | 15 |
| 621 | 10HS.16-6.6.4AN | Spadeadam200 | 120 × 8 mm5355 | 264 | 91.4 | 92 | 46 | YES | 22 | 11 |
| 507 | 10HS.16-6.6.4AN | Spadeadem200 | — | 49 | 167 | 68 | 46 | YES | 32 | 8 |
| 420 | 10HS.16-6.6.4AN | Spadeadam200 | — | 36 | 152 | 68 | 46 | YES | 17 | 5 |
| 354 | 10HS.16-6.6.4AN | Spadeadam200 | — | 32 | 122 | 68 | 46 | YES | 12 | 2 |
| 305 | 10HS.16-6.6.4AN | Spadeadem200 | — | 29 | 101 | 68 | 46 | YES | 10 | — |
| 265 | 10HS-16-6.6.4AN | Spadeadam180 | — | 17 | 82 | 22 | 22 | NO | 56 | 11 |
| 234 | 10HS-16-6.6.4AN | Spadeadam180 | — | 16 | 80 | 22 | 22 | NO | 36 | 10 |
| 209 | 10HS-16-6.6.4AN | Spadeadam180 | — | 16 | 79 | 22 | 22 | NO | 21 | 9 |
| 189 | 10HS-16-6.6.4AN | Spadeadam180 | — | 16 | 73 | 22 | 22 | NO | 14 | 9 |
| 172 | 10HS-16-6.6.4AN | Spadeadam180 | — | 15 | 67 | 22 | 22 | NO | 10 | 7 |
| 157 | 10HS-16-6.6.4AN | Spadeadam180 | — | 15 | 61 | 22 | 22 | NO | 7 | 5 |
| 145 | 10HS-16-6.6.4AN | Spadeadam180 | — | 14 | 57 | 22 | 22 | NO | 6 | 3 |
| 134 | 10HS-16-6.6.4AN | Spadeadam180 | — | 14 | 53 | 22 | 22 | NO | 5 | 2.5 |
| 125 | 10HS-16-6.6.4AN | Spadeadam180 | — | 13 | 50 | 22 | 22 | NO | 4 | 3 |
| 117 | 10HS-16-6.6.4AN | Spadeadam180 | — | 12 | 47 | 22 | 22 | NO | 3 | 1.5 |
| 110 | 10HS-16-6.6.4AN | Spadeadam180 | — | 11 | 44 | 22 | 22 | NO | 2 | 0.5 |
| 104 | 10HS-16-6.6.4AN | Spadeadam180 | — | 11 | 41 | 22 | 22 | NO | 1 | — |

The following target values for the three types of dissipative brackets are found.

The anchoring type 1 should be used at the first four floors of the building. Its dissipative parameters are:

Inward plateau at 92 kN

Outward plateau at 46 kN

Maximum inward deformation about 53 mm

Maximum outward deformation about 19 mm

In order to realize the above characteristics, the tow different following options are proposed:

Option "a"

Figure 27:
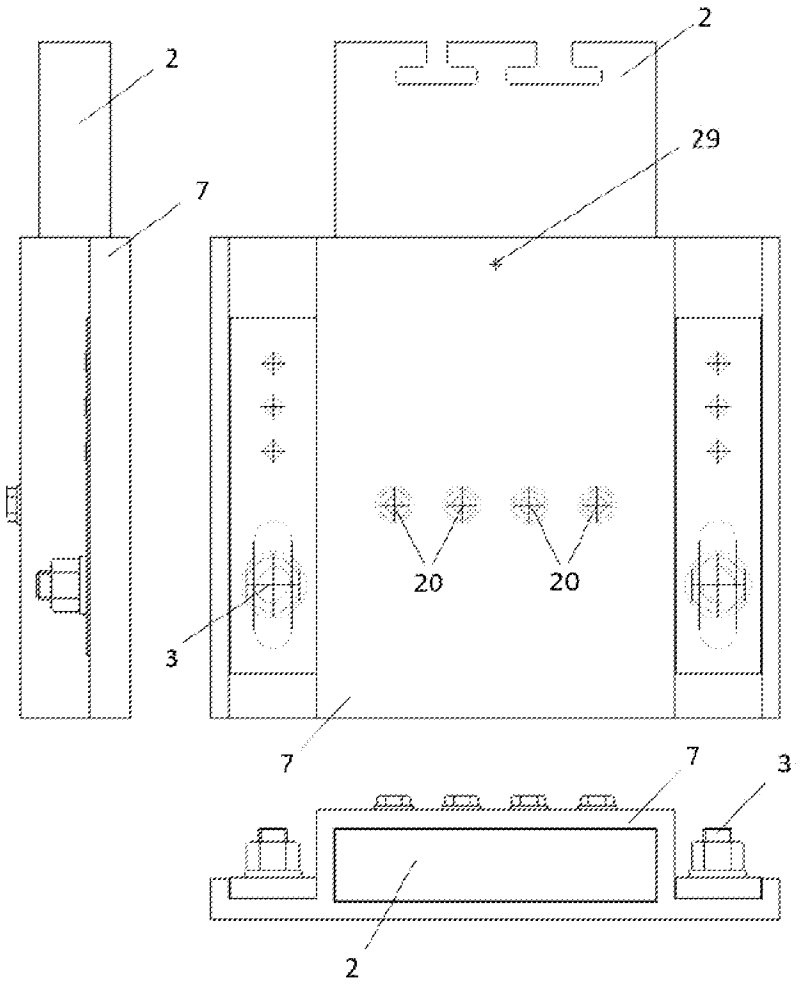
FIG. 27 shows a horizontal section of one invention anchoring system.
Figure 26:
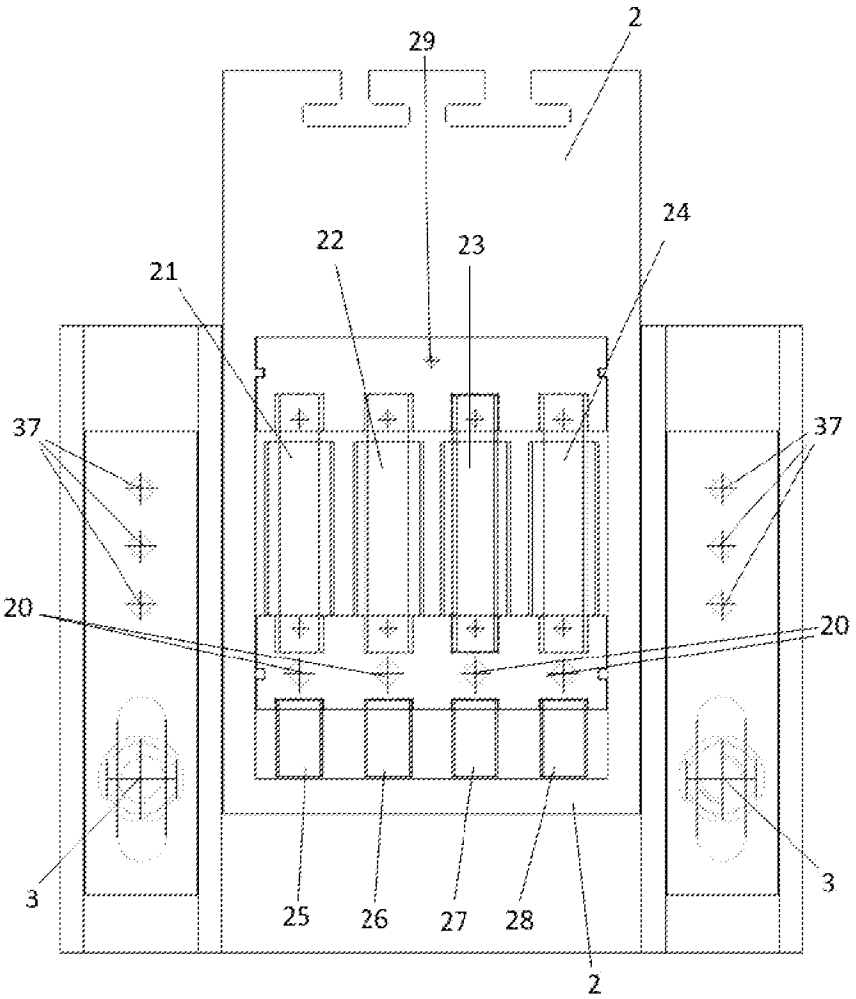
FIG. 26 shows a transparent view of one design solution of the invention anchoring system.
Figure 28:
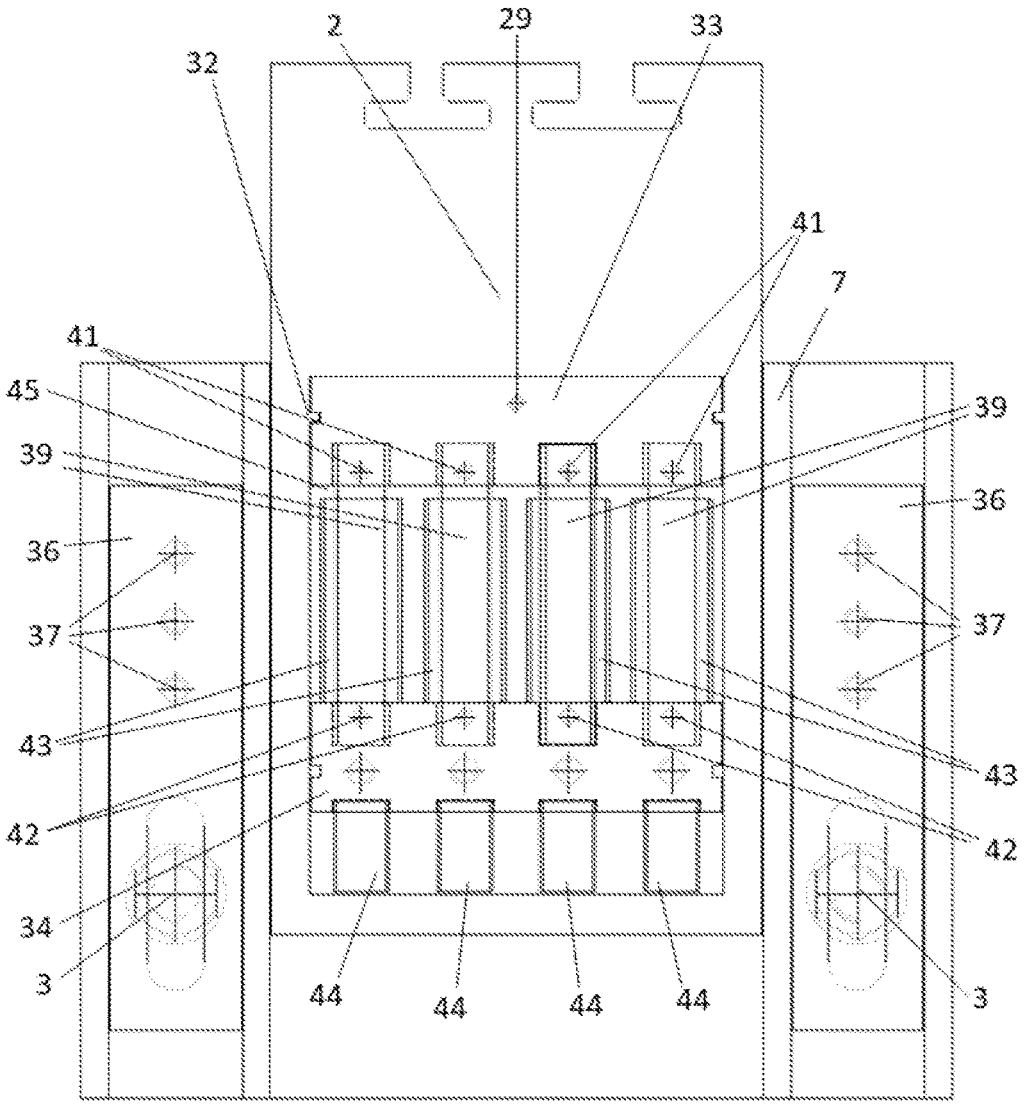
FIG. 28 shows a transparent view of embodiment of the anchoring system according to the invention.

The option "a" of the anchoring system is shown in the FIGS. 26 and 27. In FIG. 28 the major characteristics are

TABLE 5

| Characteristics of the elements of the option "a" resistance function | | | | |
|---|---|---|---|---|
| Element | Dimensions [mm] | Amplitude [kN] | Mean Value [kN] | Wave-length [mm] |
| Tube in 6060-T6 | 110(80) × 20 × 1 | 1.5 | 9.2 | 7.5 |
| Tube in 6060-T6 | 75 × 30 × 1 | 2.3 | 14.2 | 8.5 |
| Tube in 6060-T6 | 32 × 20 × 1 | 1.5 | 9.2 | 7.5 |
| Pin 8 mm A2/70 | 8 | — | 40 | — |

In this way a smoothed resistance function is obtained.

Figure 30:
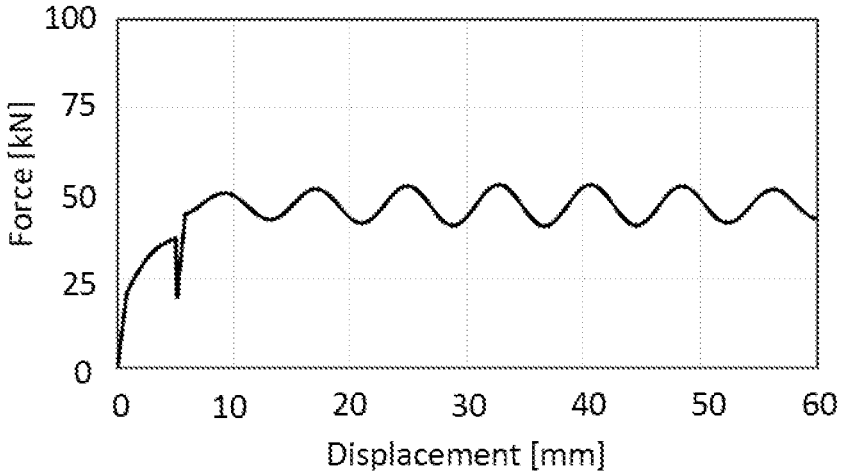
FIG. 30 shows the resistance function of one design solution of the invention anchoring system.
Figure 31:
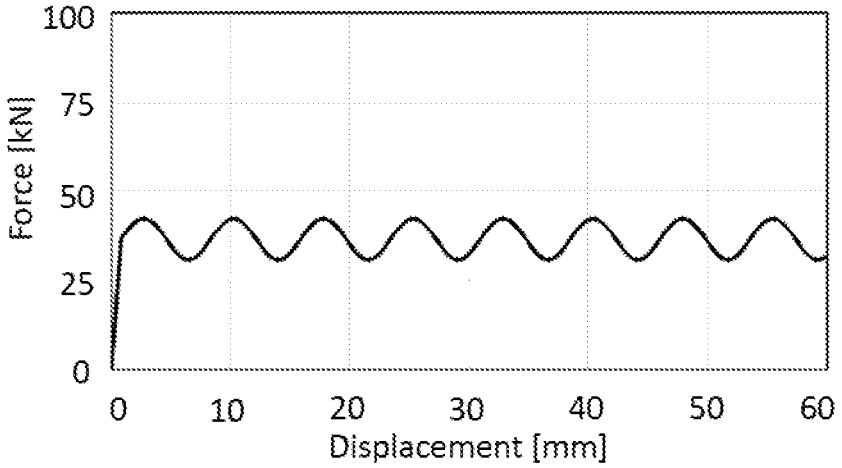
FIG. 31 shows the resistance function of a possible combination of components integrated into the invention anchoring system, The FIG. 32 shows the resistance function of an alternate combination of components integrated into the invention anchoring system, The FIG. 33 shows a horizontal cross section of an alternate design solution of the invention anchoring system.
Figure 32:
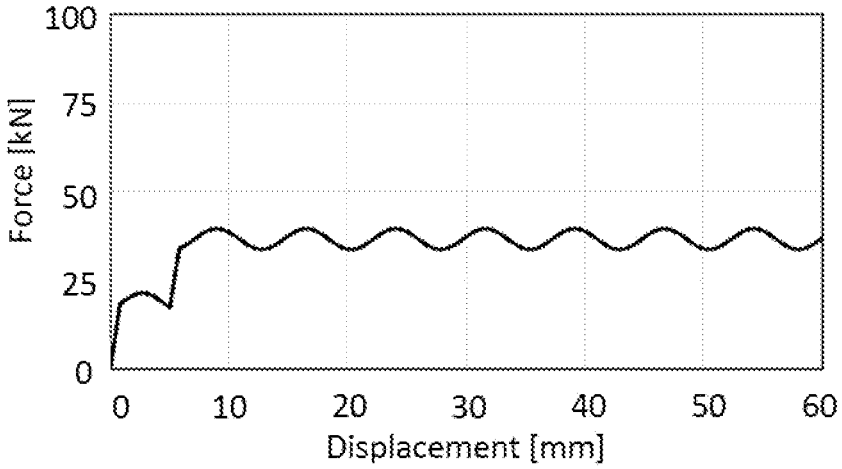

In FIG. 30 the resistance function is shown for the situation where also the pin 29 is adopted. At the end of the inward compression, the connecting pins 41 and 42 allows a limited residual resistance (around 20 kN in total) during the rebound to the equilibrium position, in order to control the velocity of the façade and limit the required plastic deformation for the dissipative elements provided to absorb the rebound outward energy. The deformation is allowed by the compression of the tubes 44. The FIGS. 31 and 32 show the resistance function for the tubes in case gaps are not provided and in case 5 mm gap is provided between the external and the central tubes. In the second lay-out the phase difference between the peaks permits a more smoothed plateau. By means of the described dissipative bracket, an average inward plateau of 95-100 kN is obtained with a plastic deformation of 60 mm and an outward plateau of 45 kN with 22-23 mm of deformation.

Option "b"

Figure 33:
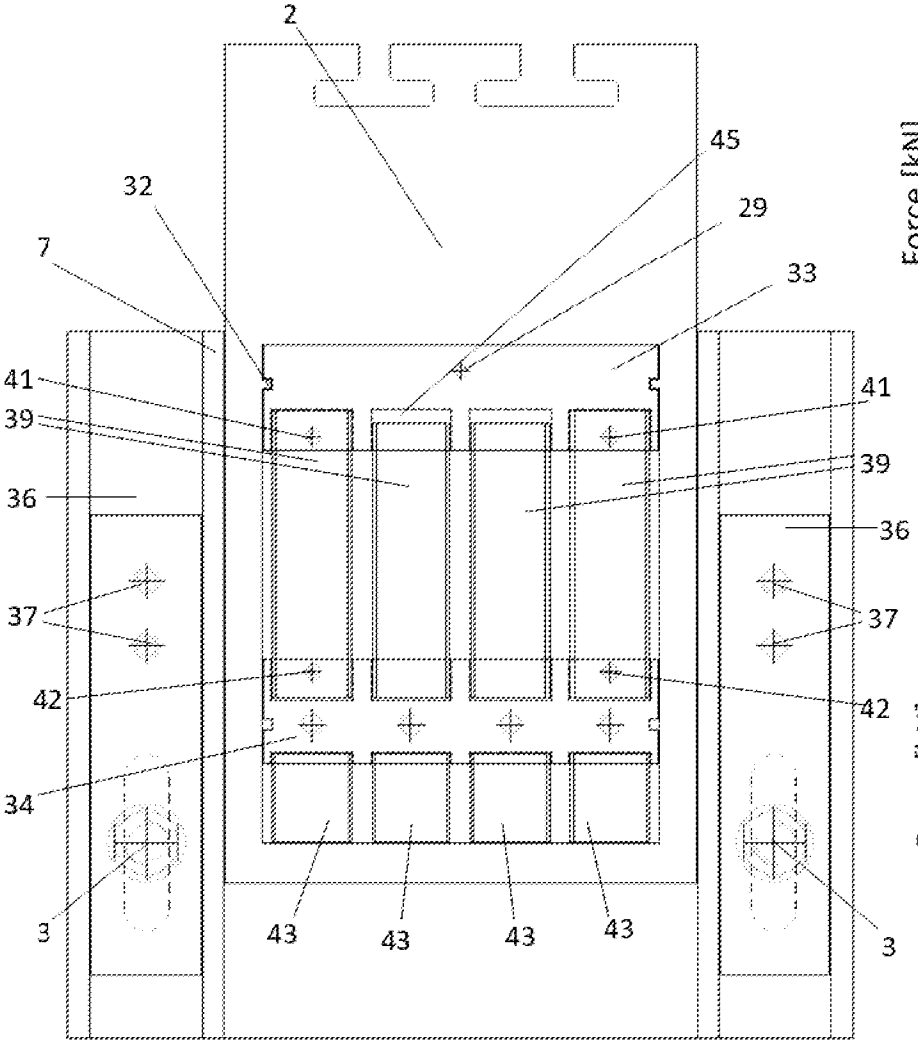

In FIG. 33 the characteristics of the option b version in aluminium alloy 6060-T6 are shown. With respect to the option "a", there are the same fundamental components. The major differences are that now we have a gap of 6 mm between the central tubes 39 and only the external tubes are connected between movable and fixed part by means of the pins 41 and 42. The initial peak force will be then reduced with respect to the previous case (favouring the mitigation of the first peak, especially when also the pin 29 is adopted), but the restoring resistance in rebound phase will be reduced as well. Even if not shown in the drawings, there is the possibility to apply a phase difference between the tubes 43, still with the target to further smooth the plateau.

Figure 34:
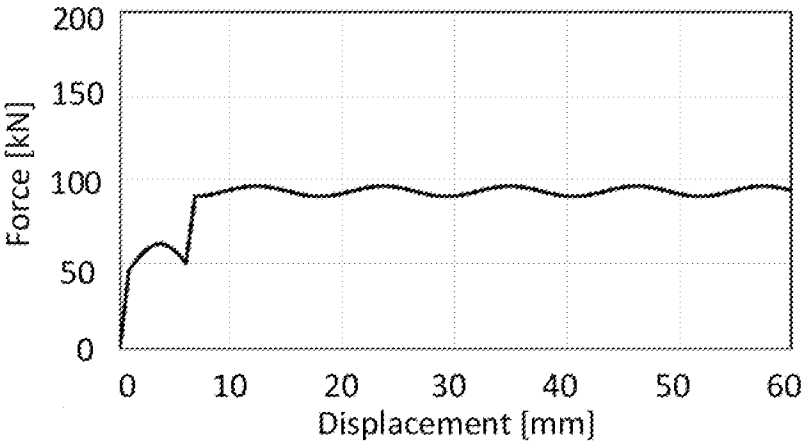
FIG. 34 shows a chart with the analytical model of the inward resistance function for one invention anchoring system.

The FIG. 34 shows the analytical model of the inward resistance function, simulated by means of the dissipative bracket design tool without adoption of the pin 29.

The function considers the characteristics of the single dissipative elements as per Table 6 and it combines them taking into account the 6 mm gap 45 between the activation of the tube 39 and tube 40 compression.

TABLE 6

Characteristics of the elements of the option "b" resistance function

| Element | Dimensions [mm] | Amplitude [kN] | Mean Value [kN] | Wave-length [mm] |
|---|---|---|---|---|
| Tube in 6060-T6 | 80 × 30 × 1.5 | 5.8 | 23.4 | 12 |
| Tube in 6060-T6 | 32 × 30 × 1 | 3.2 | 14.2 | 8.5 |
| Pin 8 mm A2/70 | 8 | — | 40 | — |

Figure 35:
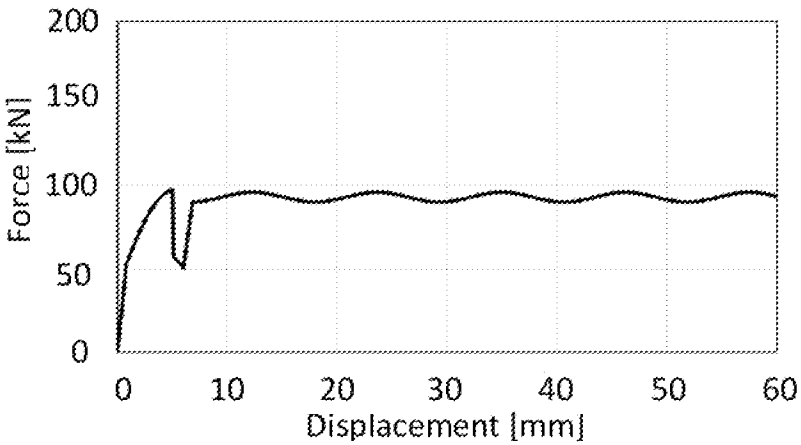
FIG. 35 shows a chart of the resistance function for one version of the invention anchoring system

In this way a smoothed resistance function is obtained, avoiding that the sine wave peaks of the single tubes occur simultaneously. In FIG. 35 the same function is shown for the case in which also the pin 29 is adopted. By means of this bracket an inward average plateau of 90 kN is obtained with a maximum deformation inward of 60 mm and with an outward plateau of 38 kN with 22-23 mm deformation.

The type 2 anchoring system of the invention is used for the floors 5-8, then at the last four floors of the podium area. The dissipative characteristics are:

Inward plateau at 68 kN

Outward plateau at 46 kN

Maximum inward deformation about 32 mm

Maximum outward deformation about 8 mm

Figure 37:
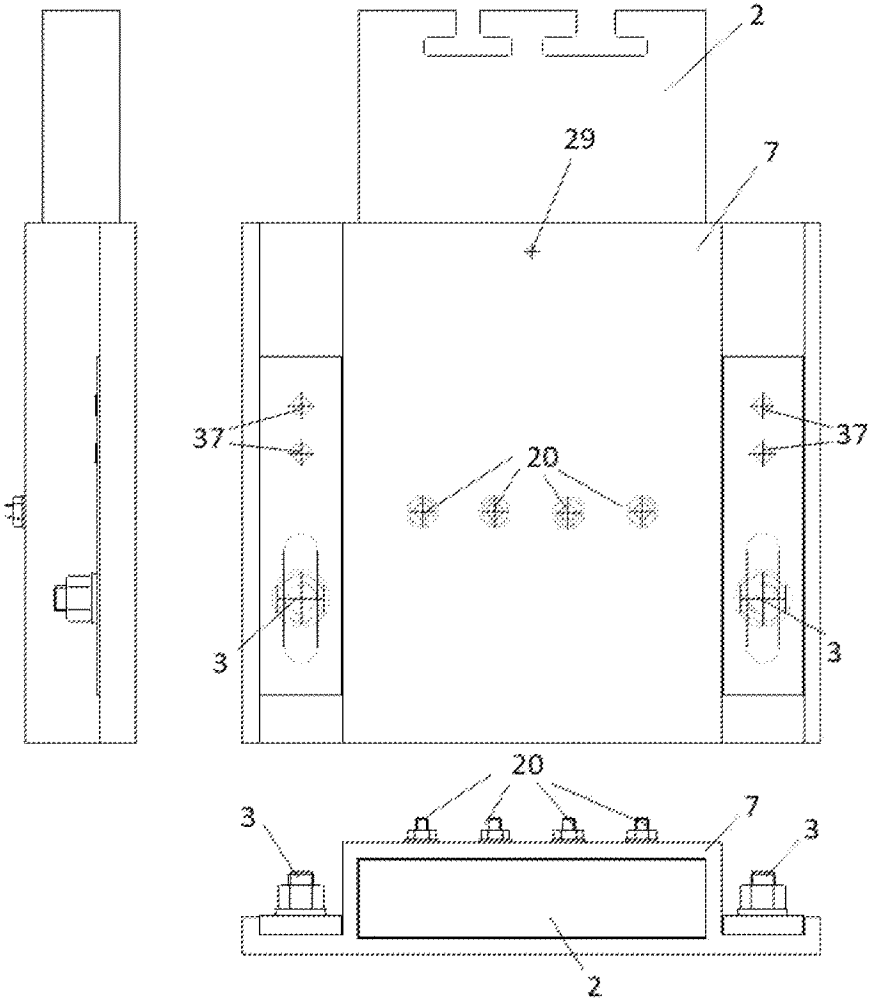
FIG. 37 shows another horizontal cross section for the same version of the invention anchoring system shown in FIG. 36.
Figure 36:
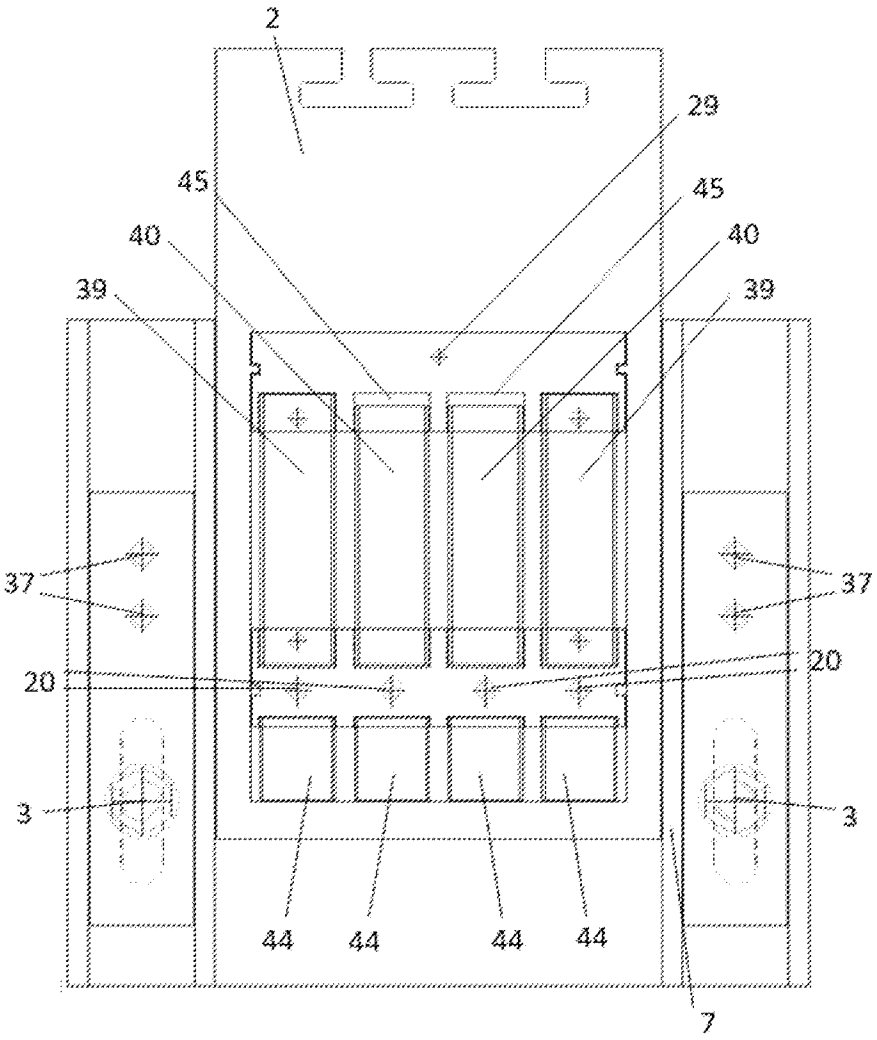
FIG. 36 shows a horizontal cross section for one version of the invention anchoring system.
Figure 38:
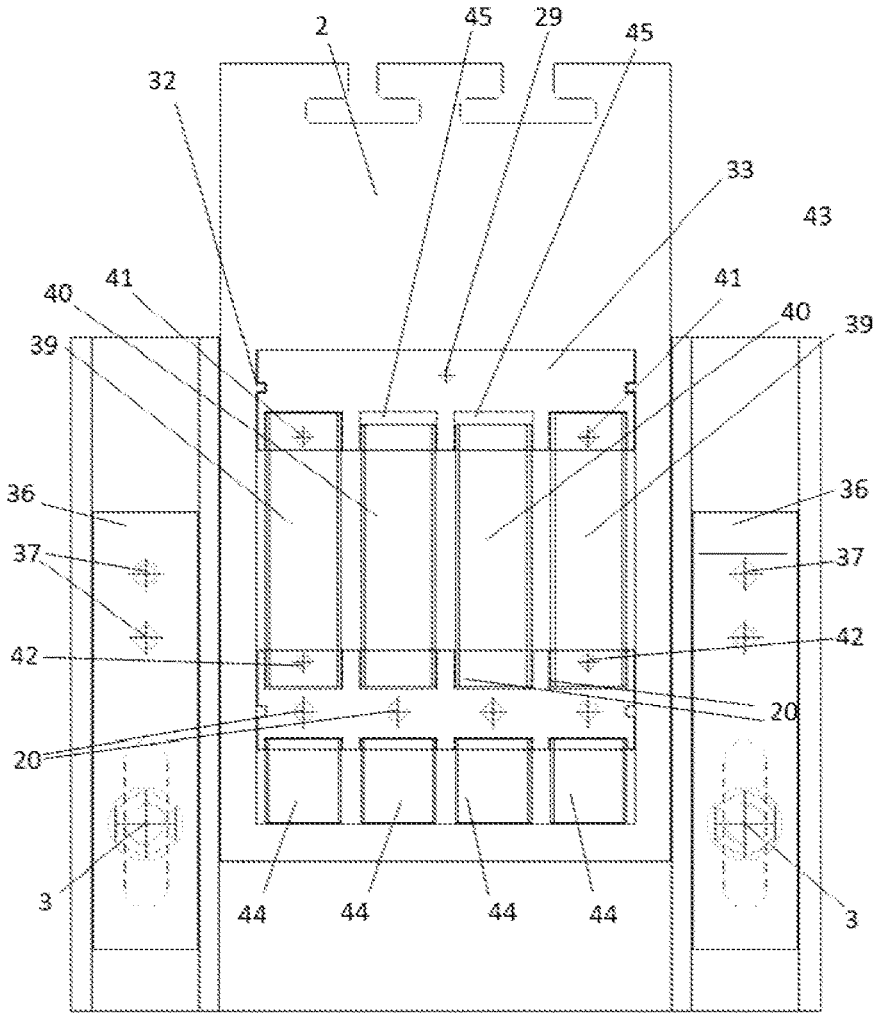
FIG. 38 shows a horizontal cross section for another version of the invention anchoring system.

The anchoring system is shown in the FIGS. 36 and 37, while in FIG. 38 the fundamental characteristics are shown, by the version in aluminium alloy 6060-T6. With respect to the previous versions, there are the following fundamental components.

Figure 39:
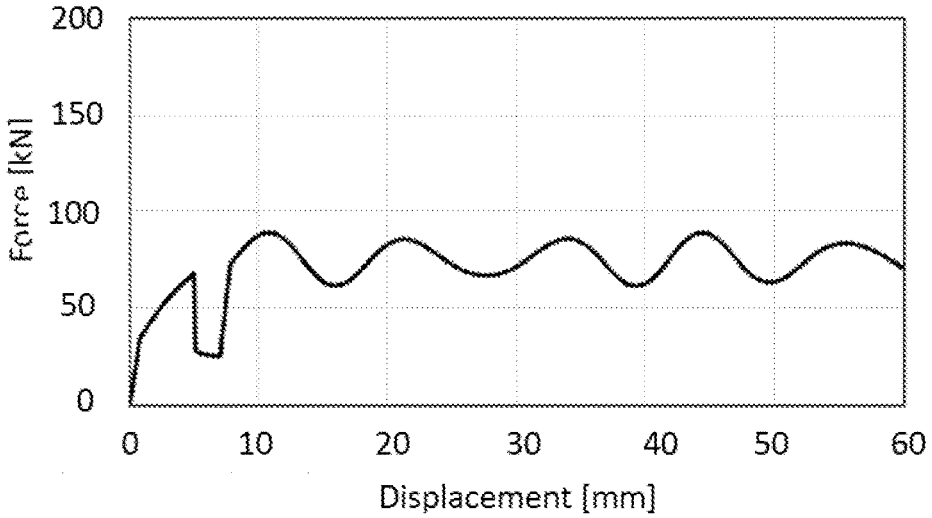
FIG. 39 shows a chart with the analytical model of the inward resistance function for one invention anchoring system.

The two couples of tubes 39 and 40 have now different thickness, which will give more issues in searching for an optimal phase difference between the tube activations. The FIG. 39 shows the analytical model of the inward resistance function, simulated by means of the dissipative bracket design tool and including the pin 29, which provides a limit to the excessive elastic deformations of the dissipative components under the conventional non blast loads and it avoids gaps between fixed and movable part.

The function considers the characteristics of the single dissipative elements as per Table 7 and it combines them taking into account the 6 mm gap 45 between the activation of the tube 39 and tube 40 compression.

TABLE 7

Characteristics of the elements of the type 2 dissipative bracket resistance function

| Element | Dimensions [mm] | Amplitude [kN] | Mean Value [kN] | Wave-length [mm] |
|---|---|---|---|---|
| Tube in 6060-T6 | 80 × 30 × 1.5 | 5.8 | 23.4 | 12 |
| Tube in 6060-T6 | 32 × 30 × 1 | 3.2 | 14.2 | 8.5 |
| Pin 8 mm A2/70 | 8 | — | 40 | — |

By means of this bracket an inward average plateau of 70 kN is obtained with a maximum deformation inward of 60 mm and with an outward plateau of 52 kN with 22-23 mm deformation. The outward plateau is overdesigned with respect to the project specification demand, which is not a problem as enough outward deformation is provided.

Figure 40:
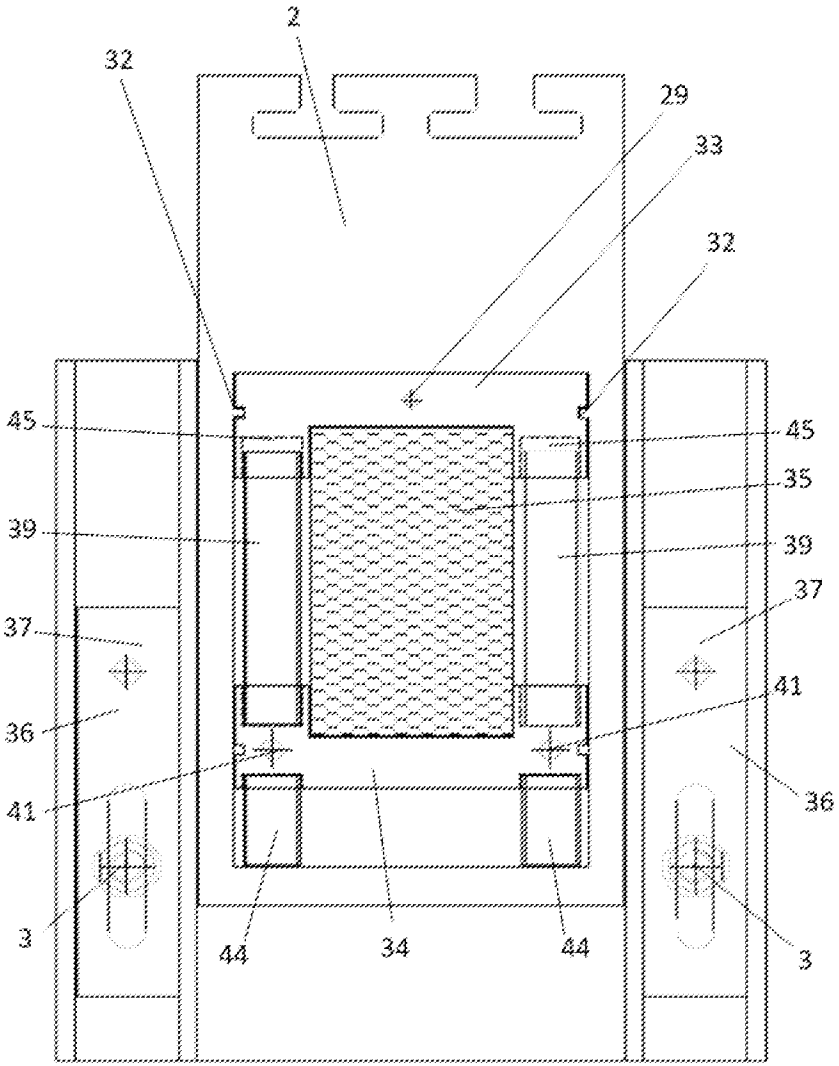
FIG. 40 shows a horizontal cross section of another invention anchoring system.

The type 3 anchoring system of the invention is used for the floors 9-20, at the tower area. FIG. 40 shows the bracket. The dissipative characteristics are:

Inward plateau at 22 kN

Outward plateau at 18 kN

Maximum inward deformation about 56 mm

Maximum outward deformation about 18 mm

Under the specific scenario, given that the maximum wind loads and activation force under blast load are similar, a pin for redundancy under wind load is recommended. The major differences of such anchoring system with respect to the previous ones are:

- The couple of tubes 39 doesn't have connecting pins between movable and fixed part, then no restoring resistance will be acting under the outward rebound. It means that it should be verified that the available deformation of the outward dissipative elements would be enough to dissipate the additional energy due to the larger velocity of the façade in rebound.
- The need for such design change depends on the target to avoid that the resistances of tubes 39 and pin 29 are superimposed during the elastic resistance phase: the activation of the tubes will happen with a phase difference 45 of around 5 mm,
- The aluminium foam 35 has a small impact on the total resistance function. As previously discussed, its role is more to provide lateral stability to the tubes and to avoid that they undergo global buckling.
- Other tubes can be added to the rear side of the bracket in order to augment the outward plateau, when required.

Figure 41:
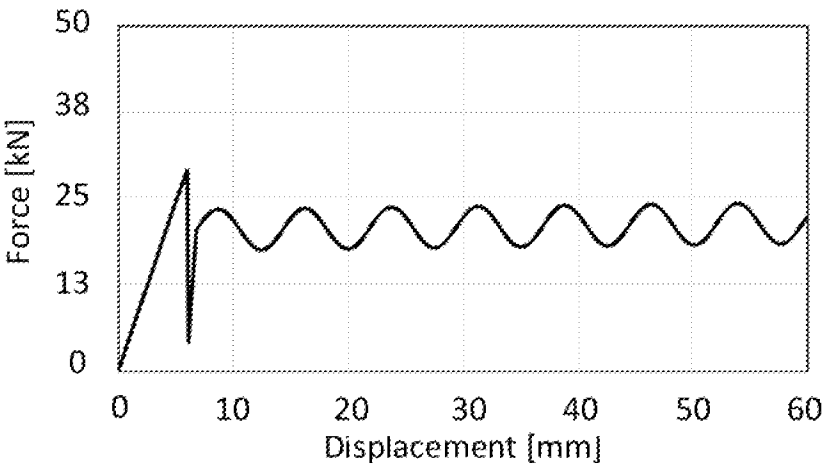
FIG. 41 shows a chart with the analytical model of the inward resistance function for the same version of the invention anchoring system shown in FIG. 40.
Figure 42:
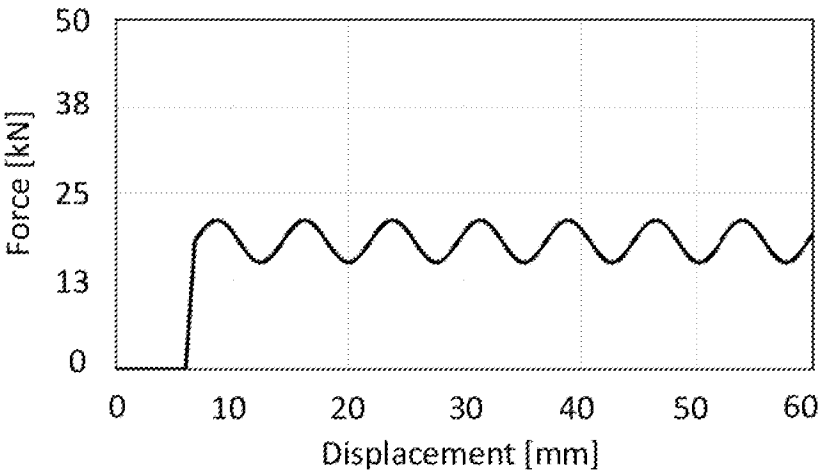
FIG. 42 shows a chart with the analytical modeling of another inward resistance function for the version of the invention shown in FIG. 40.

The FIGS. 41 and 42 show the analytical model of the inward resistance function, simulated by means of the dissipative bracket design tool and considering the characteristics of the single dissipative elements as per Table 8. The two figures show respectively the function with and without the pin 29 contribution.

TABLE 8

Characteristics of the elements of the type 3 dissipative bracket resistance function

| Element | Dimensions [mm] | Amplitude [kN] | Mean Value [kN] | Wave-length [mm] |
|---|---|---|---|---|
| Tube in 6060-T6 | 110(80) × 20 × 1 | 1.5 | 9.2 | 7.5 |
| Tube in 6060-T6 | 32 × 20 × 1 | 1.5 | 9.2 | 7.5 |
| Aluminium Foam | 70 × 30 × 120 | — | 2.2 | — |
| Pin 6 mm A2/70 | 6 | — | 27 | — |

By means of this bracket an inward average plateau of 22 kN is obtained with a maximum deformation inward of 60 mm (but activation force of 27 kN) and with an outward plateau of 18 kN with 22-23 mm deformation available.

The design solution with dissipative bracket has the following benefits with respect to the traditional one with rigid brackets:

- The same glazing can be used at the podium and at the tower. This results in a saving of around 30% of the total glazing cost that is applied on around 60% of the glazed surface of the building.
- A saving on the steel reinforcements is achieved as well at the floor 5
- At the tower, there aren't savings with regards to glazing or framing elements, but the dissipative brackets permit to avoid strengthened connections
- It is evident that the dissipative bracket reduces significantly the load transfer to the building frame. At the podium, the adoption of the true balanced design with dissipative brackets reduces the peak of the reaction of around 75% with respect to the rigid bracket case. Same benefit applies at the tower initial floors, while it disappears at the last floors.
- The design solution without dissipative brackets can be applied only to new buildings provided with a building frame capable to withstand the load transfer of the blast wave, both in terms of local slab resistance and global building behaviour, while the design solution with dissipative brackets reduces the peak of the load transfer to acceptable values even for building frame designed for conventional non blast loads only. It means that the invention is suitable to protect buildings when the façade is refurbished (for instance when the façade must be replaced because of the durability of their components), without the need to reinforce the building frame.
- In terms of material costs, the dissipative anchoring system results in around 5-6% of savings with respect to the solution with rigid brackets. This reduction is quite important, as the additional cost to enhance the façade according to the project specifications and by means of state of the art design strategy (rigid brackets) would be of around 8-9% more than the conventional façade non blast enhanced. It means that by dissipative brackets the enhancement costs are reduced to around 33%. Other savings should be considered, like those one occurring for the building frame and slabs, which should be designed for lower peak loads.

Figure 44:
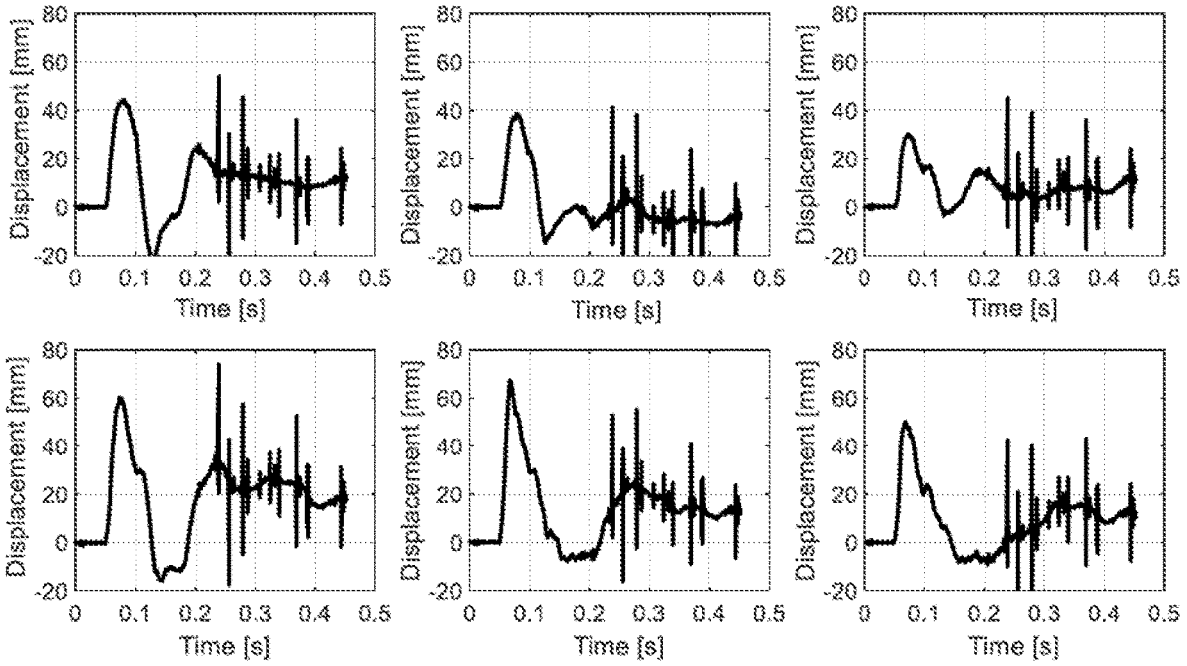
FIG. 44 shows the charts with the results of the tests on the invention anchoring system.
Figure 45:
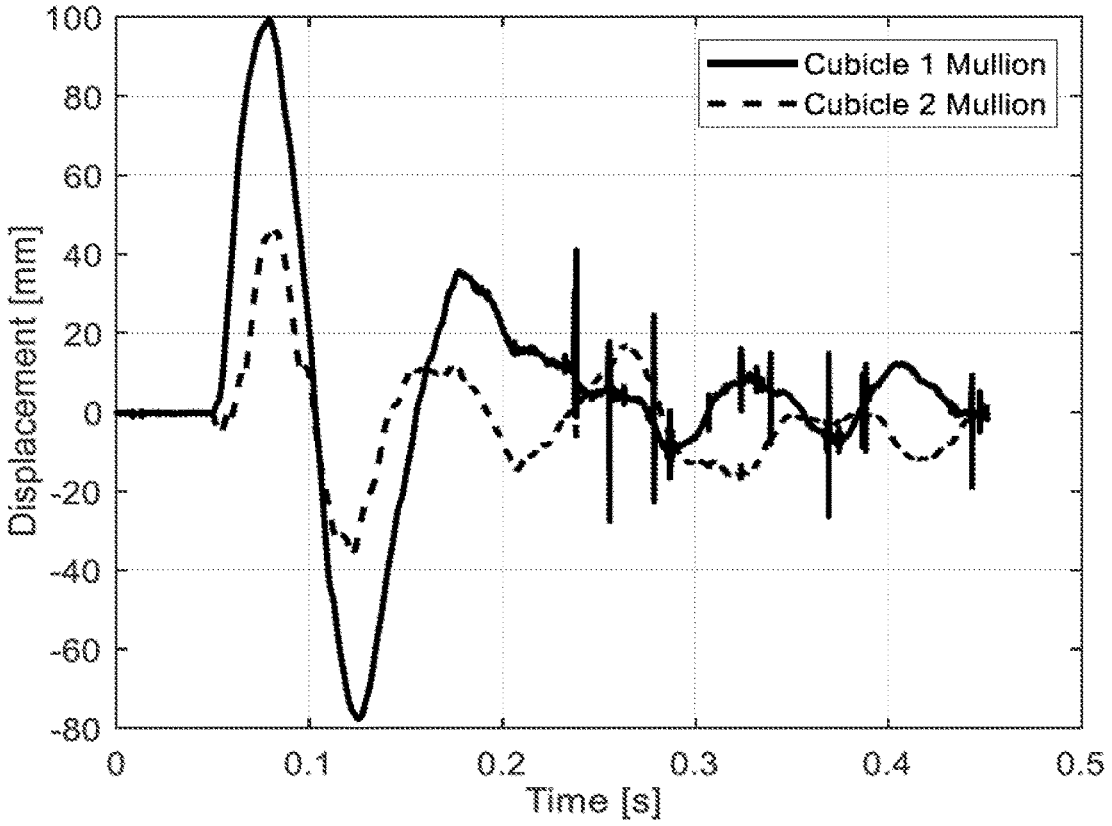
FIG. 45 shows a chart with the experimental test results on invention anchoring systems.

The dissipative bracket concept and the design solutions have been validated by means of an extensive experimental test programme. A large database of material and dissipative element behaviour has been built in order to calibrate the dissipative bracket design tool. Experimental tests have been performed also on a real scale façade sample according to the scheme of FIG. 43. The test has confirmed the activation of the brackets in compliance with the numerical simulation outcomes (FIG. 44) and the expected benefits in terms of façade mullion deflection mitigation (FIG. 45).

The invention claimed is:

1. An anchoring device for anchoring a panel or a glass pane to a building structure comprising a box-shaped container, a first attachment adapted to fix said panel or glass pane, said first attachment being slidable within said box-shaped container, a second attachment adapted to fix said box-shaped container to the building structure said first attachment and said second attachment defining a slide line along which components of first external forces act, which are discharged onto said building structure and being capable of carrying out an internal relative and mutual sliding in a first direction moving parallel to said slide line the panel or glass pane closer to said building structure under an action of said first external forces and also being capable of one external relative and mutual sliding in a second direction moving parallel to said slide line the panel or glass pane further away from said building structure under an action of second external forces in an opposite direction to the direction of said first external forces, at least a first dissipative element having a capability of dissipating compression forces acting in the first direction, at least a second dissipative element having a capability of dissipating second compression forces acting in the second direction, wherein the at least a first dissipative element and the at least a second dissipative element are different components, and wherein during said internal relative and mutual sliding in the first direction there is caused a deformation in elastic and plastic fields of said at least a first dissipative element and during said internal relative and mutual sliding in the second direction there is caused a deformation in the elastic and plastic fields of said at least a second dissipative element, thereby causing the first and second external forces to be dissipated.

2. The anchoring device according to claim 1, wherein also a third dissipative element is foreseen, having a capability of dissipating a compression force acting in the first direction and capable of increasing a dissipative function of the first dissipative element.

3. The anchoring device according to claim 1, wherein the first dissipative element comprises one or more first metal tubes with axes parallel to the sliding line or lightweight concrete or a an aluminum foam.

4. The anchoring device according to claim 3, wherein the third dissipative element comprises one or more second tubes with axes parallel to the movement of the first attachment relative to the box shaped container.

5. The anchoring device according to claim 4, wherein the second dissipative element comprises one or more third tubes with axes parallel to the slide line or to an aluminum foam structure.

6. The anchoring device according to claim 5, wherein coil springs are provided, arranged coaxially around said one or more second or third tubes.

7. The anchoring device according to claim 6, wherein an internal diameter of the springs is greater than 20% of an external diameter of the dissipative tubes.

8. The anchoring device according to claim 5, wherein four first tubes are provided, two of said tubes are arranged staggered in an axial direction in respect to the other two tubes.

9. The anchoring device according to claim 8, wherein four second tubes are provided, capable of dissipating second forces, of which two tubes are arranged staggered in an axial direction in respect to the other two tubes.

10. The anchoring device according to claim 1, wherein Teflon sheets are interposed between a first surface integral to said first attachment and a second surface integral to said second attachment for reducing friction during sliding between said first and second surfaces.

11. The anchoring device according to claim 10, wherein safety pins or bolts are provided, arranged between said first attachment and second attachment.

* * * * *